US010157705B2

(12) United States Patent
Fukushima et al.

(10) Patent No.: US 10,157,705 B2
(45) Date of Patent: Dec. 18, 2018

(54) ELECTRIC CIRCUIT

(71) Applicant: MURATA MANUFACTURING CO., LTD., Kyoto-fu (JP)

(72) Inventors: Hiromu Fukushima, Nagaokakyo (JP); Masaki Kitajima, Nagaokakyo (JP); Kuniaki Yosui, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 364 days.

(21) Appl. No.: 15/200,797

(22) Filed: Jul. 1, 2016

(65) Prior Publication Data

US 2016/0314892 A1 Oct. 27, 2016

Related U.S. Application Data

(63) Continuation of application No. PCT/JP2015/050084, filed on Jan. 6, 2015.

(30) Foreign Application Priority Data

Jan. 15, 2014 (JP) ..... 2014-004882

(51) Int. Cl.
*H01F 5/00* (2006.01)
*H01F 27/28* (2006.01)
(Continued)

(52) U.S. Cl.
CPC ..... *H01F 27/2804* (2013.01); *H01F 17/0013* (2013.01); *H01F 17/0033* (2013.01); *H01F 27/29* (2013.01); *H01F 2027/2809* (2013.01)

(58) Field of Classification Search
USPC ..... 336/200, 232, 234, 192, 83
See application file for complete search history.

(56) References Cited

U.S. PATENT DOCUMENTS 8,085,549 B2 * 12/2011 Kawano ..... H01L 29/0649 361/765
2003/0137384 A1 * 7/2003 Itou ..... H01F 17/0013 336/200
(Continued)

FOREIGN PATENT DOCUMENTS

CN 1841579 A 10/2006
CN 102044322 A 5/2011
(Continued)

OTHER PUBLICATIONS

Written Opinion issued in PCT/JP2015/050084; dated Apr. 21, 2015.
(Continued)

*Primary Examiner* — Elvin G Enad
*Assistant Examiner* — Kazi Hossain
(74) *Attorney, Agent, or Firm* — Studebaker & Brackett PC

(57) ABSTRACT

The electric circuit includes a first inductor and a third inductor that, when viewed in plan view from a first direction, wind around a first axis extending in the first direction, and a second inductor that, when viewed in plan view from the first direction, winds around a second axis extending in the first direction. A second region where the second inductor is provided overlaps, in the first direction, with a first region where the first inductor is provided or a third region where the third inductor is provided. When a common mode signal is inputted to the first inductor to third inductor, the orientation of a magnetic field produced in the first axis by the first inductor and the third inductor is opposite from the orientation of a magnetic field produced in the second axis by the second inductor.

19 Claims, 17 Drawing Sheets

(51) Int. Cl.
*H01F 17/00* (2006.01)
*H01F 27/29* (2006.01)

(56) References Cited

U.S. PATENT DOCUMENTS

| | | | | |
|---|---|---|---|---|
| 2006/0238273 | A1* | 10/2006 | Tomonari | H01F 17/0013 333/185 |
| 2009/0108958 | A1* | 4/2009 | Hadano | H03H 7/0115 333/175 |
| 2013/0056849 | A1* | 3/2013 | Nakashiba | H01L 23/48 257/531 |
| 2013/0234820 | A1 | 9/2013 | Yoo et al. | |
| 2015/0097637 | A1* | 4/2015 | Pye | H03H 11/04 333/174 |

FOREIGN PATENT DOCUMENTS

| | | | |
|---|---|---|---|
| CN | 103310946 | A | 9/2013 |
| JP | H02-91903 | A | 3/1990 |
| JP | 2013-012702 | A | 1/2013 |

OTHER PUBLICATIONS

International Search Report issued in PCT/JP2015/050084; dated Apr. 21, 2015.

Notification of the Second Office Action issued by the State Intellectual Property Office of People's Republic of China dated Aug. 21, 2017, which corresponds to Chinese Patent Application No. 201580002305.9 and is related to U.S. Appl. No. 15/200,797; with English language translation.

* cited by examiner

ELECTRIC CIRCUIT

CROSS REFERENCE TO RELATED APPLICATIONS

This application claims benefit of priority to Japanese Patent Application 2014-004882 filed Jan. 15, 2014, and to International Patent Application No. PCT/JP2015/050084 filed Jan. 6, 2015, the entire content of which is incorporated herein by reference.

TECHNICAL FIELD

The present disclosure relates to electric circuits, and particularly relates to an electric circuit including a common mode choke coil.

BACKGROUND

A ferrite core having a platform, disclosed in Japanese Unexamined Patent Application Publication No. H02-91903, is known as an example of a past disclosure regarding an electric circuit. This ferrite core includes a cylindrical ferrite core main body and a platform provided with a screw hole. A cable containing a power source line, a ground line, a signal line, and the like passes through the interior of the ferrite core main body. The ferrite core is attached to a chassis or the like of an electronic device by a screw inserted into the screw hole. This ferrite core is capable of removing common mode noise flowing in the power source line, the ground line, the signal line, and the like.

Incidentally, the ferrite core disclosed in Japanese Unexamined Patent Application Publication No. H02-91903 is attached to the cable so as to surround the periphery of the cable. A large space is therefore required to place the ferrite core, which makes it difficult to use the ferrite core inside an electronic device.

SUMMARY

Technical Problem

Accordingly, it is an object of the present disclosure to achieve a reduction in the size of an electric circuit including a common mode choke coil.

Solution to Problem

An electric circuit according to one aspect of the present disclosure comprises: a main body; a first inductor, provided in the main body, that winds around a first axis extending along a first direction when viewed in plan view from the first direction; a second inductor, provided in the main body, that winds around a second axis extending along the first direction when viewed in plan view from the first direction; and a third inductor, provided in the main body, that winds around the first axis when viewed in plan view from the first direction. A position of the first axis and a position of the second axis are different when viewed in plan view from the first direction; the first inductor, the second inductor and the third inductor form a common mode choke coil; a second region where the second inductor is provided at least partially overlaps, in the first direction, with a first region where the first inductor is provided or a third region where the third inductor is provided, or is positioned between the first region and the third region in the first direction; one each of a power source potential, a ground potential, and a first signal is applied to one each of the first inductor, the second inductor, and the third inductor so that the same potential or signal is not applied to more than one of the first inductor, the second inductor and the third inductor; and when a common mode signal is inputted to the first inductor, the second inductor and the third inductor, the orientation of a magnetic field produced in the first axis by the first inductor and the third inductor is the opposite from an orientation of a magnetic field produced in the second axis by the second inductor.

Advantageous Effects of Disclosure

According to one aspect of the present disclosure, a reduction in the size of an electric circuit including a common mode choke coil can be achieved.

DETAILED DESCRIPTION

An electronic component which is one embodiment of an electric circuit according to the present disclosure will be described hereinafter with reference to the drawings.

(Configuration of Electronic Component)

Figure 1:
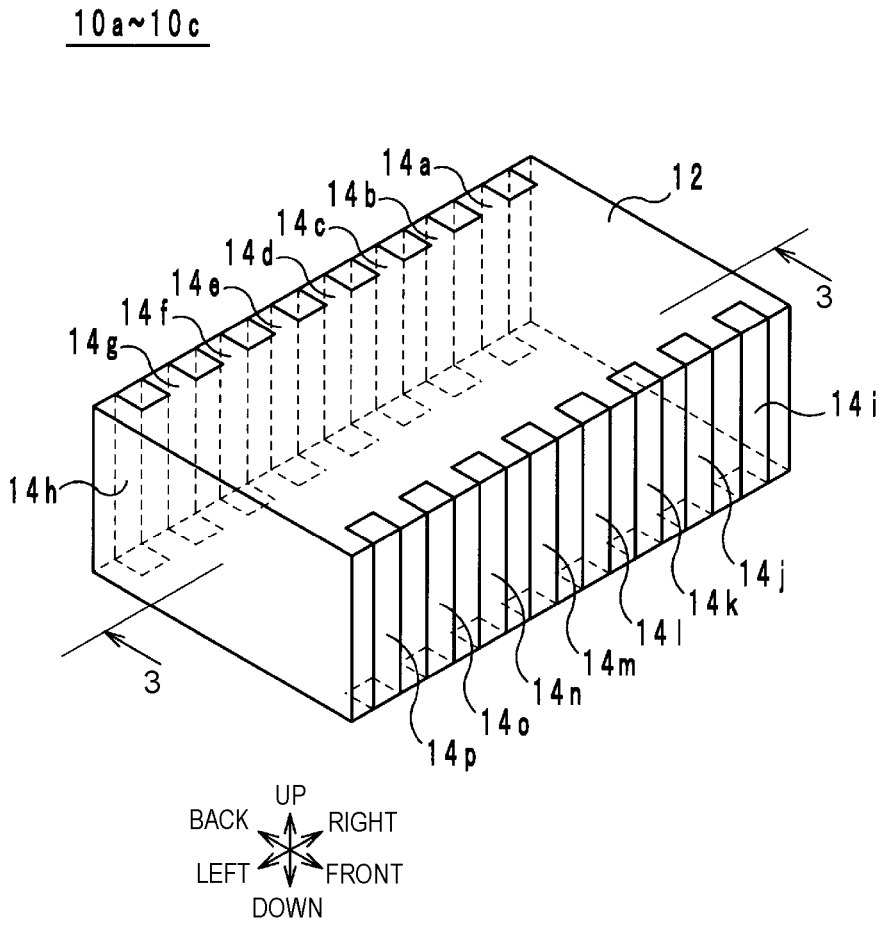
FIG. 1 is an external perspective view of electronic components 10*a* to 10*c*.
Figure 2A:
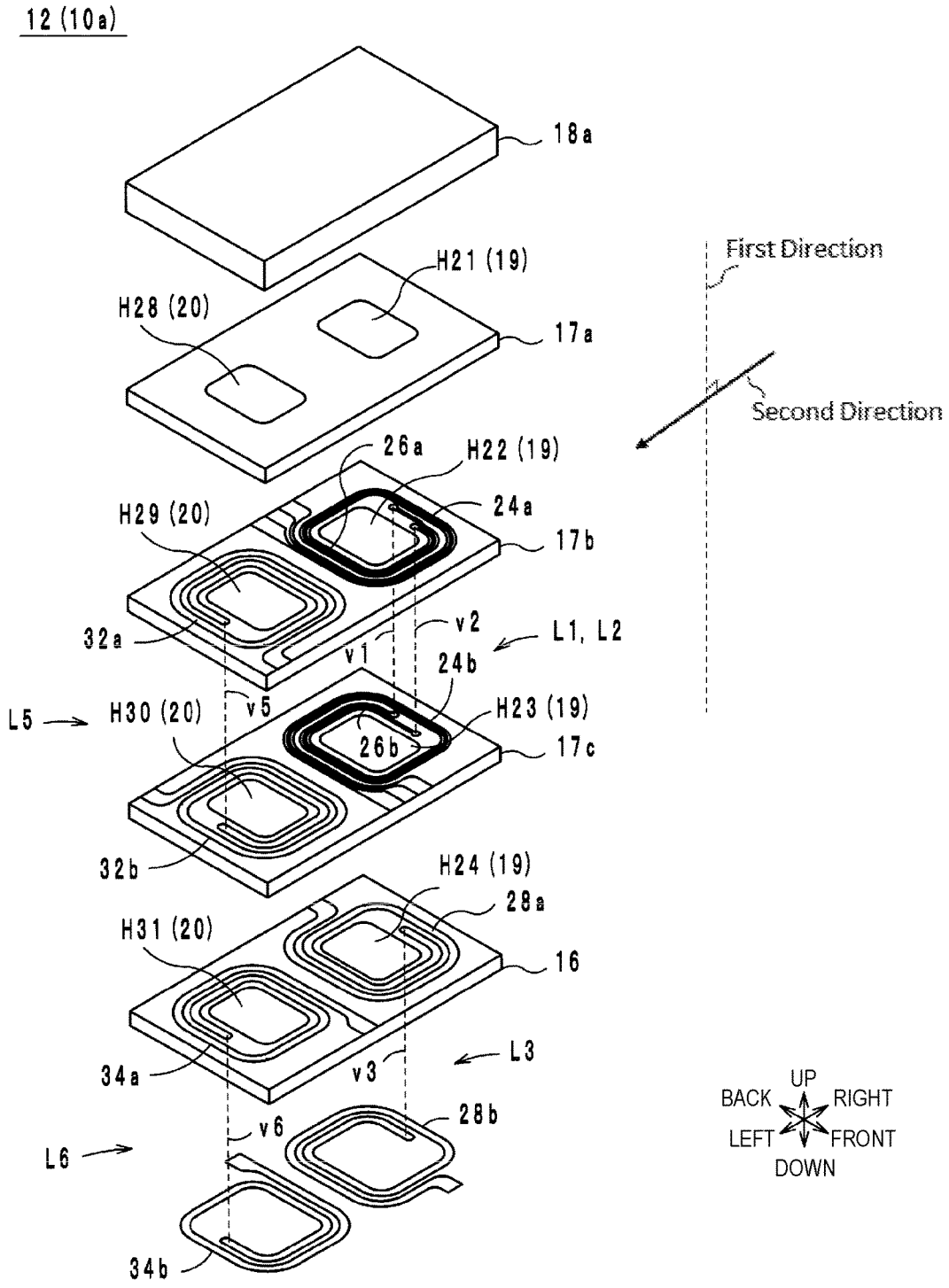
FIG. 2A is an exploded perspective view illustrating a multilayer body 12 of the electronic component 10*a*.
Figure 2B:
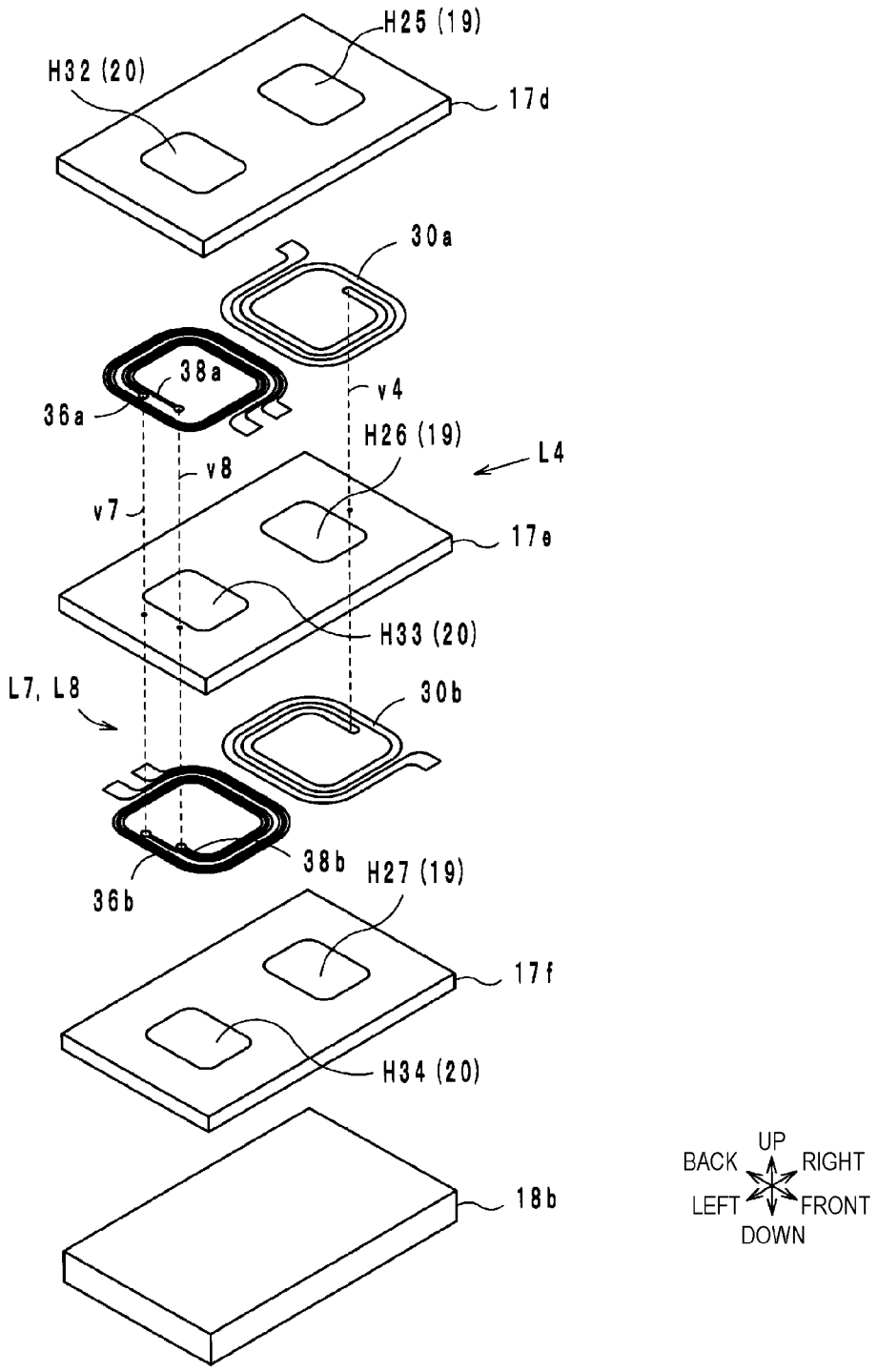
FIG. 2B is an exploded perspective view illustrating the multilayer body 12 of the electronic component 10*a*.
Figure 3:
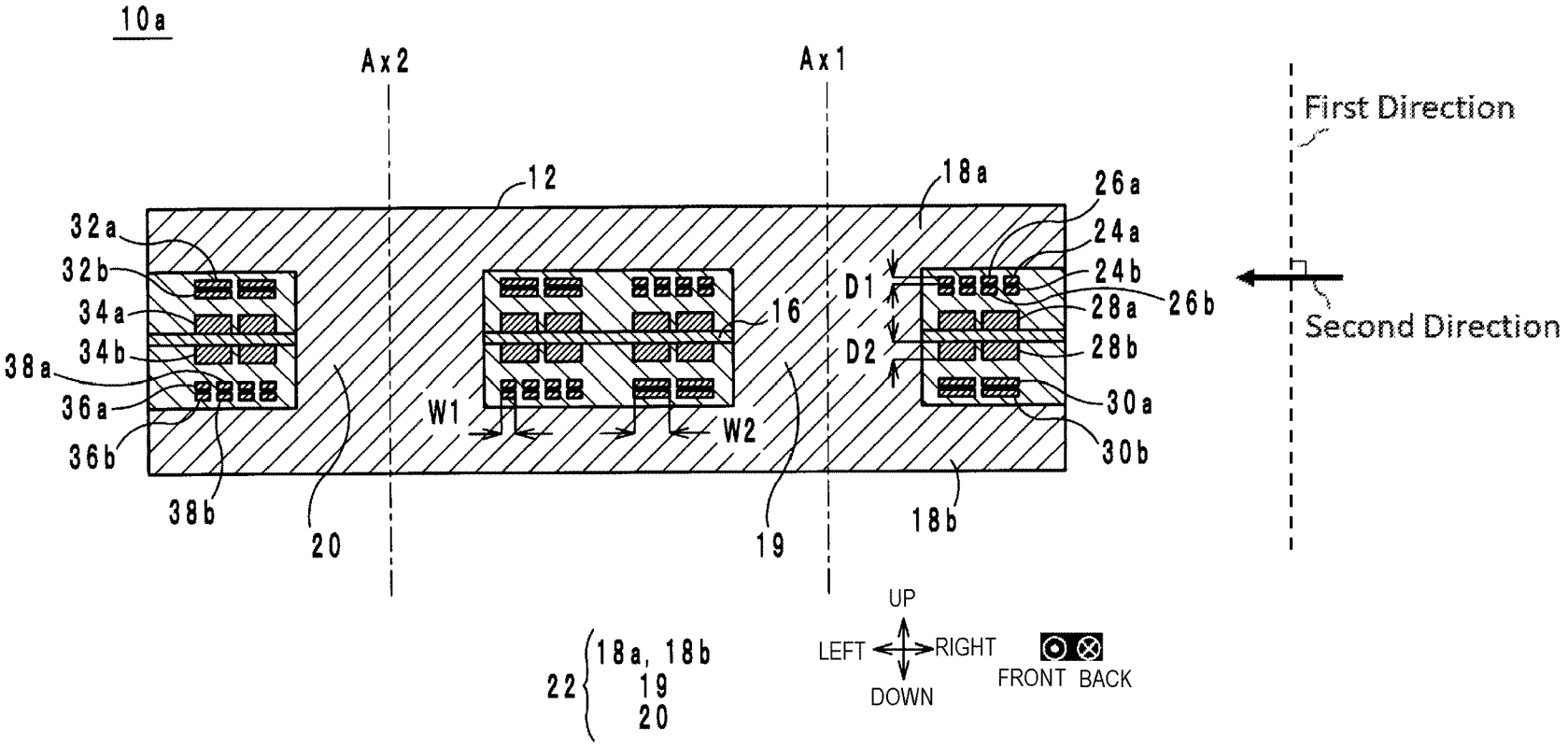
FIG. 3 is a cross-sectional structural diagram illustrating the electronic component 10*a* illustrated in FIG. 1 along a 3-3 line.
Figure 4:
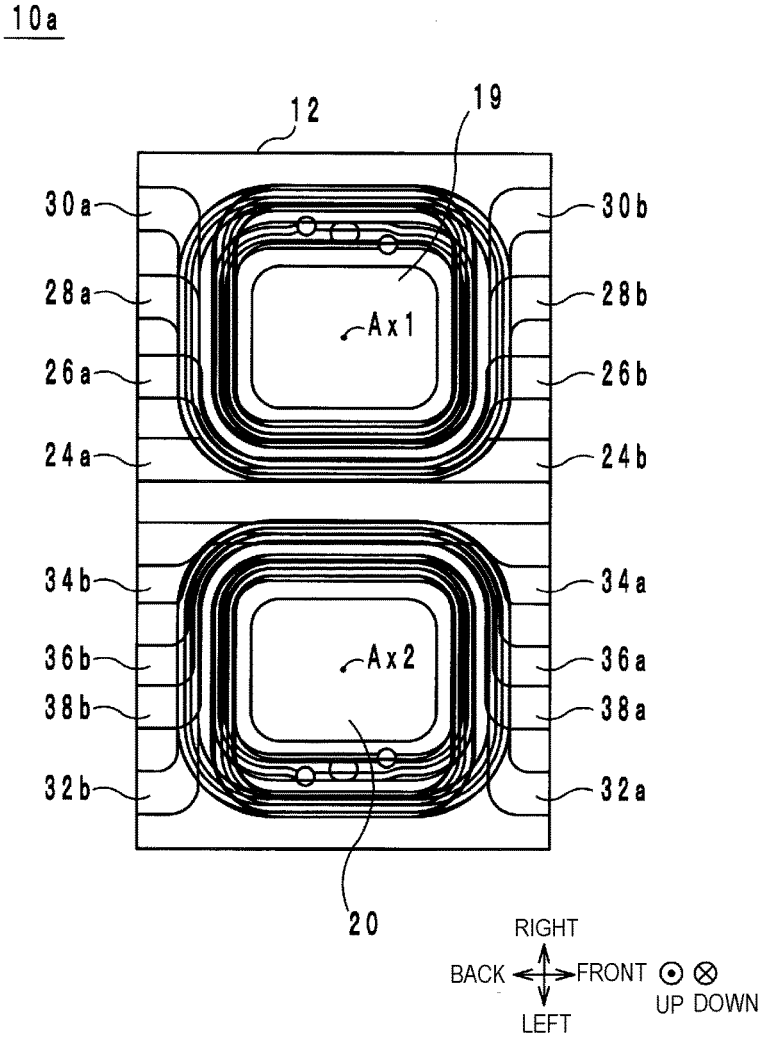
FIG. 4 is a diagram illustrating a plan view of coils L1 to L8 in the electronic component 10*a* from above.

First, the configuration of the electronic component will be described with reference to the drawings. FIG. 1 is an external perspective view of electronic components 10*a* to 10*c*. FIGS. 2A and 2B are exploded perspective views illustrating a multilayer body 12 of the electronic component 10*a*. FIG. 3 is a cross-sectional structural diagram illustrating the electronic component 10*a* illustrated in FIG. 1 along a 3-3 line. FIG. 4 is a diagram illustrating a plan view of coils L1 to L8 in the electronic component 10*a* from above.

In the following, a multi-layering direction of the multilayer body 12 is defined as an up-down direction. When the multilayer body 12 is viewed in plan view from above, a direction in which the longer sides of the multilayer body 12 extend is defined as a left-right direction, and a direction in which the shorter sides of the multilayer body 12 extend is defined as a front-back direction. The up-down direction, the left-right direction, and the front-back direction are orthogonal to one another. Note that the up-down direction, the left-right direction, and the front-back direction described here need not be the same as those corresponding directions during actual use.

The electronic component 10*a* is a chip-type electronic component that contains a common mode choke coil, and as illustrated in FIGS. 1 to 4, includes the multilayer body 12, outer electrodes 14*a* to 14*p*, and the coils L1 to L8.

As illustrated in FIGS. 1, 2, and 3, the multilayer body 12 has a rectangular parallelepiped shape, and includes an insulating substrate 16, insulation layers 17*a* to 17*f*, and a magnetic body 22. The magnetic body 22 includes magnetic body layers 18*a* and 18*b* and magnetic body portions 19 and 20.

The multilayer body 12 is constituted of the magnetic body layer 18*a*, the insulation layers 17*a* to 17*c*, the insulating substrate 16, the insulation layers 17*d* to 17*f*, and the magnetic body layer 18*b* being laminated in that order from top to bottom. Hereinafter, a primary surface on an upper side of the insulating substrate 16, the insulation layers 17*a* to 17*f*, and the magnetic body layers 18*a* and 18*b* will be called an upper surface, and a primary surface on a lower side of the insulating substrate 16, the insulation layers 17*a* to 17*f*, and the magnetic body layers 18*a* and 18*b* will be called a bottom surface.

The insulating substrate 16 is a plate-shaped member having a rectangular shape when viewed in plan view from above. The insulating substrate 16 is constituted of a plate-shaped epoxy resin containing glass cloth, and is comparatively rigid. The thickness of the insulating substrate 16 in the up-down direction (called simply a thickness hereinafter) is 50 μm.

When viewed in plan view from above, the insulation layers 17*a* to 17*f* have rectangular shapes. The insulation layers 17*a* to 17*f* are formed from epoxy resin, and are more flexible than the insulating substrate 16. The insulation layers 17*a*, 17*b*, 17*e*, and 17*f* are 20 μm thick. The insulation layers 17*c* and 17*d* are 50 μm thick.

Two holes H24 and H31 are provided in the insulating substrate 16 so as to pass therethrough in the up-down direction. To be more specific, as illustrated in FIGS. 2A and 2B, the hole H24, which has a rectangular shape, is provided near the center (a point of intersection between diagonal lines) of a right-half region of the insulating substrate 16, when viewed in plan view from above. Meanwhile, the hole H31, which has a rectangular shape, is provided near the center (a point of intersection between diagonal lines) of a left-half region of the insulating substrate 16, when viewed in plan view from above.

Furthermore, holes H21 to H23 and H25 to H27, which have rectangular shapes, are provided near the respective centers (the points of intersection between diagonal lines) of right-half regions of the insulation layers 17*a* to 17*f*, when viewed in plan view from above. Likewise, holes H28 to H30 and H32 to H34, which have rectangular shapes, are provided near the respective centers (the points of intersection between diagonal lines) of left-half regions of the insulation layers 17*a* to 17*f*, when viewed in plan view from above.

Here, the holes H21 to H27 match and overlap when viewed in plan view from above. Accordingly, a prismatic space that extends in the up-down direction is formed within a right-half region in the multilayer body 12. The magnetic body portion 19 is provided within the space formed by the holes H21 to H27 being aligned in a continuous manner.

Likewise, the holes H28 to H34 match and overlap when viewed in plan view from above. Accordingly, a prismatic space that extends in the up-down direction is formed within a left-half region in the multilayer body 12. The magnetic body portion 20 is provided within the space formed by the holes H28 to H34 being aligned in a continuous manner.

As described above, the magnetic body portion 19 and the magnetic body portion 20 extend in the up-down direction parallel to each other, and thus pass through the insulation layers 17*a* to 17*c*, the insulating substrate 16, and the insulation layers 17*d* to 17*f*. Furthermore, the surface area of a cross-section of the magnetic body portion 19 orthogonal to the up-down direction is substantially equal to the surface area of a cross-section of the magnetic body portion 20 orthogonal to the up-down direction. The magnetic body portions 19 and 20 are formed, for example, from a mixture of a metal magnetic body and an epoxy-based resin.

When viewed in plan view from above, the magnetic body layers 18*a* and 18*b* have rectangular shapes. The magnetic body layers 18*a* and 18*b* are formed from a mixture of a metal magnetic body and an epoxy resin, and are more flexible than the insulating substrate 16. The magnetic body layers 18*a* and 18*b* are 250 μm thick.

By being laminated to the top of the insulation layer 17*a*, the magnetic body layer 18*a* connects an upper end of the magnetic body portion 19 to an upper end of the magnetic body portion 20. Likewise, by being laminated to the bottom of the insulation layer 17*f*, the magnetic body layer 18*b* connects a lower end of the magnetic body portion 19 to a lower end of the magnetic body portion 20. As a result, the magnetic body 22 constituted of the magnetic body layers 18*a* and 18*b* and the magnetic body portions 19 and 20 forms a ring shape when viewed in plan view from the front, as illustrated in FIG. 3.

The outer electrodes 14*a* to 14*h* are, as illustrated in FIG. 1, provided on a rear-face of the multilayer body 12, and are arranged in that order from right to left. The outer electrodes 14*a* to 14*h* have band shapes extending in the up-down direction, and are bent over onto a top surface and a bottom surface of the multilayer body 12.

The outer electrodes 14*i* to 14*p* are, as illustrated in FIG. 1, provided on a front-face of the multilayer body 12, and are arranged in that order from right to left. The outer electrodes 14*i* to 14*p* have band shapes extending in the up-down direction, and are bent over onto the top surface and the bottom surface of the multilayer body 12.

The coils L1 to L8 are inductors provided within the multilayer body 12, and by electromagnetically coupling with each other, form a common mode choke coil. The coils L1 to L8 are formed from a conductive metal such as copper. The configurations of the coils L1 to L8 will be described in detail hereinafter.

As illustrated in FIGS. 3 and 4, an axis extending in the up-down direction near the center of the right-half region of the multilayer body 12 is called an axis Ax1 (a second axis), and an axis extending in the up-down direction near the center of the left-half region of the multilayer body 12 is called an axis Ax2 (a first axis). The position of the axis Ax1 and the position of the axis Ax2 differ when viewed in plan view from above. The magnetic body portion 19 is provided along the axis Ax1, and the magnetic body portion 20 is provided along the axis Ax2.

The coil L1 (a second inductor) is, as illustrated in FIG. 2A, provided in the right-half region of the multilayer body 12, and includes coil conductors 24*a* and 24*b* and a via hole conductor v1. The coil conductor 24*a* is provided on an upper surface of the insulation layer 17*b*, and when viewed in plan view from above, has a spiral shape that progresses inward while winding counterclockwise around the magnetic body portion 19, with the axis Ax1 serving as a center axis thereof. The center axis corresponds to the center of the outer edge of the portion of the coil conductor that forms the helix, when viewed in plan view from above. Hereinafter, an end portion of the coil conductor 24*a* on an upstream side in the counterclockwise direction will be called an upstream end, and an end portion of the coil conductor 24*a* on a downstream side in the counterclockwise direction will be called a downstream end. The upstream end of the coil conductor 24*a* is drawn out slightly to the right from the center of the longer side on the back of the insulation layer 17*b*, and is connected to the outer electrode 14*d*. The downstream end of the coil conductor 24*a* is positioned near the center of a right side of the magnetic body portion 19, when viewed in plan view from above.

The coil conductor 24*b* is provided on an upper surface of the insulation layer 17*c*, and when viewed in plan view from above, has a spiral shape that progresses outward while winding counterclockwise around the magnetic body portion 19, with the axis Ax1 serving as a center axis thereof. Hereinafter, an end portion of the coil conductor 24*b* on an upstream side in the counterclockwise direction will be called an upstream end, and an end portion of the coil conductor 24*b* on a downstream side in the counterclockwise direction will be called a downstream end. The upstream end of the coil conductor 24*b* is positioned near the center of a right side of the magnetic body portion 19, when viewed in plan view from above. The downstream end of the coil conductor 24*b* is drawn out slightly to the right from the center of the longer side on the front of the insulation layer 17*b*, and is connected to the outer electrode 141.

The via hole conductor v1 passes through the insulation layer 17*b* in the up-down direction and connects the downstream end of the coil conductor 24*a* to the upstream end of the coil conductor 24*b*.

The coil L2 (a fourth inductor) is, as illustrated in FIG. 2A, provided in the right-half region of the multilayer body 12, and includes coil conductors 26*a* and 26*b* and a via hole conductor v2. The coil conductor 26*a* is provided on an upper surface of the insulation layer 17*b*, and when viewed in plan view from above, has a spiral shape that progresses inward while winding counterclockwise around the magnetic body portion 19, with the axis Ax1 serving as a center axis thereof. Meanwhile, the coil conductor 26*a* runs parallel to substantially the entire length of the coil conductor 24*a* on a central side of the coil conductor 24*a*. Hereinafter, an end portion of the coil conductor 26*a* on an upstream side in the counterclockwise direction will be called an upstream end, and an end portion of the coil conductor 26*a* on a downstream side in the counterclockwise direction will be called a downstream end. The upstream end of the coil conductor 26*a* is drawn out to the longer side on the back of the insulation layer 17*b* and is connected to the outer electrode 14*c*, and is positioned further to the right than the upstream end of the coil conductor 24*a*. The downstream end of the coil conductor 26*a* is positioned near the center of a right side of the magnetic body portion 19, when viewed in plan view from above.

The coil conductor 26*b* is provided on an upper surface of the insulation layer 17*c*, and when viewed in plan view from above, has a spiral shape that progresses outward while winding counterclockwise around the magnetic body portion 19, with the axis Ax1 serving as a center axis thereof. Meanwhile, the coil conductor 26*b* runs parallel to substantially the entire length of the coil conductor 24*b* on a central side of the coil conductor 24*b*. Hereinafter, an end portion of the coil conductor 26*b* on an upstream side in the counterclockwise direction will be called an upstream end, and an end portion of the coil conductor 26*b* on a downstream side in the counterclockwise direction will be called a downstream end. The upstream end of the coil conductor 26*b* is positioned near the center of a right side of the magnetic body portion 19, when viewed in plan view from above. The downstream end of the coil conductor 24*b* is drawn out to the longer side on the front of the insulation layer 17*b* and is connected to the outer electrode 14*k*, and is positioned further to the right than the downstream end of the coil conductor 24*b*.

The via hole conductor v2 passes through the insulation layer 17*b* in the up-down direction and connects the downstream end of the coil conductor 26*a* to the upstream end of the coil conductor 26*b*.

As described thus far, the coils L1 and L2 run parallel along their entire lengths, and have substantially the same structure. In other words, the number of turns in the coils L1 and L2 are both approximately 13/4 turns. Meanwhile, the coil conductors 24*a*, 24*b*, 26*a*, and 26*b* all have a line width of a width W1. The coil conductors 24*a*, 24*b*, 26*a*, and 26*b* all have a thickness in the up-down direction (called simply a thickness hereinafter) of a thickness D1. As such, resistance values of the coils L1 and L2 are substantially equal, and furthermore, inductance values of the coils L1 and L2 are also substantially equal. The width W1 is 50 μm, for example. The thickness D1 is 35 μm, for example.

Signals Sig1 and Sig2 are applied to these coils L1 and L2, respectively. To be more specific, the outer electrode 14*d* serves as an input terminal for the signal Sig1 and the outer electrode 141 serves as an output terminal for the signal Sig1. Likewise, the outer electrode 14*c* serves as an input terminal for the signal Sig2 and the outer electrode 14*k* serves as an output terminal for the signal Sig2. The signal Sig1 and the signal Sig2 are high-frequency signals, and are differential transmission signals.

The coil conductors 24*a* and 24*b* and the via hole conductor v1 that constitute the coil L1 are provided in the insulation layers 17*b* and 17*c*. The coil conductors 26*a* and 26*b* and the via hole conductor v2 that constitute the coil L2 are provided in the insulation layers 17*b* and 17*c*. As such, the region where the coil L1 is provided matches the region where the coil L2 is provided in the up-down direction.

The coil L3 is, as illustrated in FIG. 2A, provided in the right-half region of the multilayer body 12, and includes coil conductors 28*a* and 28*b* and a via hole conductor v3. The coil conductor 28*a* is provided on an upper surface of the insulating substrate 16, and when viewed in plan view from above, has a spiral shape that progresses inward while winding counterclockwise around the magnetic body portion 19, with the axis Ax1 serving as a center axis thereof. Hereinafter, an end portion of the coil conductor 28*a* on an upstream side in the counterclockwise direction will be called an upstream end, and an end portion of the coil conductor 28*a* on a downstream side in the counterclockwise direction will be called a downstream end. The upstream end of the coil conductor 28*a* is drawn out to the longer side on the back of the insulating substrate 16 and is connected to the outer electrode 14*b*, and is positioned further to the right than the upstream end of the coil conductor 26*a*. The downstream end of the coil conductor 28*a* is positioned near the center of a right side of the magnetic body portion 19, when viewed in plan view from above.

The coil conductor 28*b* is provided on a bottom surface of the insulating substrate 16, and when viewed in plan view from above, has a spiral shape that progresses outward while winding counterclockwise around the magnetic body portion 19, with the axis Ax1 serving as a center axis thereof. Hereinafter, an end portion of the coil conductor 28*b* on an upstream side in the counterclockwise direction will be called an upstream end, and an end portion of the coil conductor 28*b* on a downstream side in the counterclockwise direction will be called a downstream end. The upstream end of the coil conductor 28*b* is positioned near the center of a right side of the magnetic body portion 19, when viewed in plan view from above. The downstream end of the coil conductor 28*b* is drawn out to the longer side on the front of the insulating substrate 16 and is connected to the outer electrode 14*j*, and is positioned further to the right than the downstream end of the coil conductor 26*b*.

The via hole conductor v3 passes through the insulating substrate 16 in the up-down direction and connects the downstream end of the coil conductor 28*a* to the upstream end of the coil conductor 28*b*.

As described above, the coil L3 runs parallel to the coils L1 and L2 along its entire length, when viewed in plan view from above. In other words, the number of turns in the coil L3 is approximately 13/4 turns. However, the line width of the coil conductors 28*a* and 28*b* is a width W2 that is greater than the width W1. Likewise, the thickness of the coil conductors 28*a* and 28*b* is a thickness D2 that is greater than the thickness D1. Accordingly, the coil L3 has a lower resistance value than the resistance value of the coils L1 and L2. The width W2 is 200 μm, for example. The thickness D2 is 100 μm, for example.

A ground potential Vgnd1 is applied to this coil L3. To be more specific, the outer electrode 14*b* serves as an input terminal for the ground potential Vgnd1 and the outer electrode 14*j* serves as an output terminal for the ground potential Vgnd1. The ground potential Vgnd1 is a reference potential.

The coil L4 is, as illustrated in FIG. 2B, provided in the right-half region of the multilayer body 12, and includes coil conductors 30*a* and 30*b* and a via hole conductor v4. The coil conductor 30*a* is provided on a bottom surface of the insulation layer 17*d*, and when viewed in plan view from above, has a spiral shape that progresses inward while winding counterclockwise around the magnetic body portion 19, with the axis Ax1 serving as a center axis thereof. Hereinafter, an end portion of the coil conductor 30*a* on an upstream side in the counterclockwise direction will be called an upstream end, and an end portion of the coil conductor 30*a* on a downstream side in the counterclockwise direction will be called a downstream end. The upstream end of the coil conductor 30*a* is drawn out to the longer side on the back of the insulation layer 17*d* and is connected to the outer electrode 14*a*, and is positioned further to the right than the upstream end of the coil conductor 28*a*. The downstream end of the coil conductor 30*a* is positioned near the center of a right side of the magnetic body portion 19, when viewed in plan view from above.

The coil conductor 30*b* is provided on a bottom surface of the insulation layer 17*e*, and when viewed in plan view from above, has a spiral shape that progresses outward while winding counterclockwise around the magnetic body portion 19, with the axis Ax1 serving as a center axis thereof. Hereinafter, an end portion of the coil conductor 30*b* on an upstream side in the counterclockwise direction will be called an upstream end, and an end portion of the coil conductor 30*b* on a downstream side in the counterclockwise direction will be called a downstream end. The upstream end of the coil conductor 30*b* is positioned near the center of a right side of the magnetic body portion 19, when viewed in plan view from above. The downstream end of the coil conductor 30*b* is drawn out to the longer side on the front of the insulating substrate 16 and is connected to the outer electrode 14*i*, and is positioned further to the right than the downstream end of the coil conductor 28*b*.

The via hole conductor v4 passes through the insulation layer 17*e* in the up-down direction and connects the downstream end of the coil conductor 30*a* to the upstream end of the coil conductor 30*b*.

As described above, the coil L4 runs parallel to the coil L3 along its entire length, when viewed in plan view from above. In other words, the number of turns in the coil L4 is approximately 13/4 turns. Meanwhile, the line width of the coil conductors 30*a* and 30*b* is the width W2. The thickness of the coil conductors 30*a* and 30*b* is the thickness D1.

A power source potential Vacc1 is applied to this coil L4. To be more specific, the outer electrode 14*a* serves as an input terminal for the power source potential Vacc1 and the outer electrode 14*i* serves as an output terminal for the power source potential Vacc1. The power source potential Vacc1 is a higher potential than the ground potential.

As described above, the center axis of the coils L1 to L4 is the axis Ax1, and the center axes match each other when viewed in plan view from above.

The coil L5 (a first inductor) is, as illustrated in FIG. 2A, provided in the left-half region of the multilayer body 12, and includes coil conductors 32*a* and 32*b* and a via hole conductor v5. The coil conductor 32*a* is provided on an upper surface of the insulation layer 17*b*, and when viewed in plan view from above, has a spiral shape that progresses outward while winding clockwise around the magnetic body portion 20, with the axis Ax2 serving as a center axis thereof. Hereinafter, an end portion of the coil conductor 32*a* on an upstream side in the clockwise direction will be called an upstream end, and an end portion of the coil conductor 32*a* on a downstream side in the clockwise direction will be called a downstream end. The upstream end of the coil conductor 32*a* is positioned near the center of a left side of the magnetic body portion 20, when viewed in plan view from above. The downstream end of the coil conductor 32*a* is drawn out in the vicinity of a left end of the longer side on the front of the insulation layer 17*b*, and is connected to the outer electrode 14*p*.

The coil conductor 32*b* is provided on an upper surface of the insulation layer 17*c*, and when viewed in plan view from above, has a spiral shape that progresses inward while winding clockwise around the magnetic body portion 20, with the axis Ax2 serving as a center axis thereof. Hereinafter, an end portion of the coil conductor 32*b* on an upstream side in the clockwise direction will be called an upstream end, and an end portion of the coil conductor 32*b* on a downstream side in the clockwise direction will be called a downstream end. The upstream end of the coil conductor 32*b* is drawn out in the vicinity of a left end of the longer side on the back of the insulation layer 17*c*, and is connected to the outer electrode 14*h*. The downstream end of the coil conductor 32*b* is positioned near the center of the left side of the magnetic body portion 20, when viewed in plan view from above.

The via hole conductor v5 passes through the insulation layer 17*b* in the up-down direction and connects the upstream end of the coil conductor 32*a* to the downstream end of the coil conductor 32*b*.

This coil L5 has approximately 13/4 turns. Meanwhile, the line width of the coil conductors 32*a* and 32*b* is the width W2. The thickness of the coil conductors 32*a* and 32*b* is the thickness D1. Accordingly, the resistance value of the coil L5 is substantially equal to the resistance value of the coil L4. Likewise, the inductance value of the coil L5 is substantially equal to the inductance value of the coil L4.

A power source potential Vacc2 is applied to this coil L5. To be more specific, the outer electrode 14*h* serves as an input terminal for the power source potential Vacc2 and the outer electrode 14*p* serves as an output terminal for the power source potential Vacc2. The power source potential Vacc2 is a higher potential than the ground potential.

The coil L6 (a third inductor) is, as illustrated in FIG. 2A, provided in the left-half region of the multilayer body 12, and includes coil conductors 34*a* and 34*b* and a via hole conductor v6. The coil conductor 34*a* is provided on an upper surface of the insulating substrate 16, and when viewed in plan view from above, has a spiral shape that progresses outward while winding clockwise around the magnetic body portion 20, with the axis Ax2 serving as a center axis thereof. Hereinafter, an end portion of the coil conductor 34*a* on an upstream side in the clockwise direction will be called an upstream end, and an end portion of the coil conductor 34*a* on a downstream side in the clockwise direction will be called a downstream end. The upstream end of the coil conductor 34*a* is positioned near the center of a left side of the magnetic body portion 20, when viewed in plan view from above. The downstream end of the coil conductor 34*a* is drawn out slightly to the left from the center of the longer side on the front of the insulating substrate 16, and is connected to the outer electrode 14*m*.

The coil conductor 34*b* is provided on a bottom surface of the insulating substrate 16, and when viewed in plan view from above, has a spiral shape that progresses inward while winding clockwise around the magnetic body portion 20, with the axis Ax2 serving as a center axis thereof. Hereinafter, an end portion of the coil conductor 34*b* on an upstream side in the clockwise direction will be called an upstream end, and an end portion of the coil conductor 34*b* on a downstream side in the clockwise direction will be called a downstream end. The upstream end of the coil conductor 34*b* is drawn out slightly to the left from the center of the longer side on the back of the insulating substrate 16, and is connected to the outer electrode 14*e*. The downstream end of the coil conductor 34*b* is positioned near the center of the left side of the magnetic body portion 20, when viewed in plan view from above.

The via hole conductor v6 passes through the insulating substrate 16 in the up-down direction and connects the upstream end of the coil conductor 34*a* to the downstream end of the coil conductor 34*b*.

As described above, the coil L6 runs parallel to the coil L5 along its entire length, when viewed in plan view from above. In other words, the number of turns in the coil L6 is approximately 13/4 turns. Meanwhile, the line width of the coil conductors 34*a* and 34*b* is the width W2. The thickness of the coil conductors 34*a* and 34*b* is the thickness D2. As such, inductance values of the coils L3 and L6 are substantially equal, and furthermore, resistance values of the coils L3 and L6 are also substantially equal.

A ground potential Vgnd2 is applied to this coil L6. To be more specific, the outer electrode 14*e* serves as an input terminal for the ground potential Vgnd2 and the outer electrode 14*m* serves as an output terminal for the ground potential Vgnd2. The ground potential Vgnd2 is a reference potential. The ground potential Vgnd2 is applied to the outer conductor or the like of a coaxial cable, and is thus also called a shield potential.

As described above, the coil conductors 24*a* and 24*b* and the via hole conductor v1 that constitute the coil L1 are provided in the insulation layers 17*b* and 17*c*. The coil conductors 32*a* and 32*b* and the via hole conductor v5 that constitute the coil L5 are provided in the insulation layers 17*b* and 17*c* in which the coil L1 is provided. Meanwhile, the coil conductors 34*a* and 34*b* and the via hole conductor v6 that constitute the coil L6 are provided in the insulating substrate 16. As such, the region where the coil L1 is provided overlaps, in the up-down direction, with the region where the coil L5 is provided. In the electronic component 10*a*, the region where the coil L1 is provided matches the region where the coil L5 is provided in the up-down direction.

The power source potential Vacc2, the ground potential Vgnd2, and the signal Sig1 are each applied to one of the coil L1, the coil L5, and the coil L6 so that the same potentials or signal is not applied to the coil L1, the coil L5, and the coil L6. Furthermore, the signal Sig2 is applied to the coil L2. Accordingly, in the electronic component 10*a*, the power source potential Vacc2, the ground potential Vgnd2, and the signals Sig1 and Sig2 are each applied to one of the coil L1, the coil L2, the coil L5, and the coil L6 so that the same potentials or signals are not applied to the coil L1, the coil L2, the coil L5, and the coil L6.

The coil L7 is, as illustrated in FIG. 2B, provided in the left-half region of the multilayer body 12, and includes coil conductors 36*a* and 36*b* and a via hole conductor v7. The coil conductor 36*a* is provided on a bottom surface of the insulation layer 17*d*, and when viewed in plan view from above, has a spiral shape that progresses outward while winding clockwise around the magnetic body portion 20, with the axis Ax2 serving as a center axis thereof. Hereinafter, an end portion of the coil conductor 36*a* on an upstream side in the clockwise direction will be called an upstream end, and an end portion of the coil conductor 36*a* on a downstream side in the clockwise direction will be called a downstream end. The upstream end of the coil conductor 36*a* is positioned near the center of a left side of the magnetic body portion 20, when viewed in plan view from above. The downstream end of the coil conductor 36*a* is drawn out to the longer side on the front of the insulation layer 17*d* and is connected to the outer electrode 14*n*, and is positioned further to the left than the downstream end of the coil conductor 34*a*.

The coil conductor 36*b* is provided on a bottom surface of the insulation layer 17*e*, and when viewed in plan view from above, winds in a spiral shape that progresses inward while winding clockwise around the magnetic body portion 20, with the axis Ax2 serving as a center axis thereof. Hereinafter, an end portion of the coil conductor 36*b* on an upstream side in the clockwise direction will be called an upstream end, and an end portion of the coil conductor 36*b* on a downstream side in the clockwise direction will be called a downstream end. The upstream end of the coil conductor 36*b* is drawn out to the longer side on the back of the insulating substrate 16 and is connected to the outer electrode 14*f*. The downstream end of the coil conductor 36*b* is positioned near the center of the left side of the magnetic body portion 20, when viewed in plan view from above.

The via hole conductor v7 passes through the insulation layer 17*e* in the up-down direction and connects the upstream end of the coil conductor 36*a* to the downstream end of the coil conductor 36*b*.

The coil L8 is, as illustrated in FIG. 2B, provided in the left-half region of the multilayer body 12, and includes coil conductors 38*a* and 38*b* and a via hole conductor v8. The coil conductor 38*a* is provided on a bottom surface of the insulation layer 17*d*, and when viewed in plan view from above, has a spiral shape that progresses outward while winding clockwise around the magnetic body portion 20, with the axis Ax2 serving as a center axis thereof. Meanwhile, the coil conductor 38*a* runs parallel to substantially the entire length of the coil conductor 36*a* on a central side of the coil conductor 36*a*. Hereinafter, an end portion of the coil conductor 38*a* on an upstream side in the clockwise direction will be called an upstream end, and an end portion of the coil conductor 38*a* on a downstream side in the clockwise direction will be called a downstream end. The upstream end of the coil conductor 38*a* is positioned near the center of a left side of the magnetic body portion 20, when viewed in plan view from above. The downstream end of the coil conductor 38*a* is drawn out to the longer side on the front of the insulation layer 17*d* and is connected to the outer electrode 14*o*, and is positioned between the upstream end of the coil conductor 36*a* and the upstream end of the coil conductor 32*a*.

The coil conductor 38*b* is provided on a bottom surface of the insulation layer 17*e*, and when viewed in plan view from above, winds in a spiral shape that progresses inward while winding clockwise around the magnetic body portion 20, with the axis Ax2 serving as a center axis thereof. Meanwhile, the coil conductor 38*b* runs parallel to substantially the entire length of the coil conductor 36*b* on a central side of the coil conductor 36*b*. Hereinafter, an end portion of the coil conductor 38*b* on an upstream side in the clockwise direction will be called an upstream end, and an end portion of the coil conductor 38*b* on a downstream side in the clockwise direction will be called a downstream end. The upstream end of the coil conductor 38*b* is drawn out to the longer side on the back of the insulation layer 17*e* and is connected to the outer electrode 14*g*, and is positioned between the upstream end of the coil conductor 36*b* and the upstream end of the coil conductor 32*b*. The downstream end of the coil conductor 38*b* is positioned near the center of the left side of the magnetic body portion 20, when viewed in plan view from above.

The via hole conductor v8 passes through the insulation layer 17*e* in the up-down direction and connects the upstream end of the coil conductor 38*a* to the downstream end of the coil conductor 38*b*.

As described thus far, the coils L7 and L8 run parallel along their entire lengths, and have substantially the same structure. In other words, the number of turns in the coils L7 and L8 are both approximately 13/4 turns. Meanwhile, the coil conductors 36*a*, 36*b*, 38*a*, and 38*b* all have a line width of the width W1. The thickness of the coil conductors 36*a*, 36*b*, 38*a*, and 38*b* is the thickness D1. As such, inductance values of the coils L1, L2, L7, and L8 are substantially equal, and furthermore, resistance values of the coils L1, L2, L7, and L8 are also substantially equal. Furthermore, the coil L7 and the coil L8 are provided in the same position with respect to the up-down direction.

Signals Sig3 and Sig4 are applied to these coils L7 and L8, respectively. To be more specific, the outer electrode 14*f* serves as an input terminal for the signal Sig3 and the outer electrode 14*n* serves as an output terminal for the signal Sig3. Likewise, the outer electrode 14*g* serves as an input terminal for the signal Sig4 and the outer electrode 14*o* serves as an output terminal for the signal Sig4. The signal Sig3 and the signal Sig4 are high-frequency signals, and are differential transmission signals.

As described above, the center axis of the coils L5 to L8 is the axis Ax2, and the center axes match each other when viewed in plan view from above.

Incidentally, in the electronic component 10*a*, the outer electrodes 14*a* to 14*h* are used as input terminals and the outer electrodes 14*i* to 14*p* are used as output terminals. In the coils L1 to L8, when facing the outer electrodes 14*i* to 14*p* from the outer electrodes 14*a* to 14*h*, the direction in which the coils L1 to L4 turn and the direction in which the coils L5 to L8 turn are reversed. Accordingly, when a common mode signal is inputted to each of the coils L1 to L8 through the outer electrodes 14*a* to 14*h*, the orientation of a magnetic field produced by the coils L1 to L4 at the axis Ax1 and the orientation of a magnetic field produced by the coils L5 to L8 at the axis Ax2 are reversed.

Meanwhile, the magnetic body portion 19 passes through the insulation layers 17*a* to 17*f* and the insulating substrate 16 in the up-down direction, along the axis Ax1. As such, the magnetic body portion 19 passes through the insides of the coils L1 to L4 in the up-down direction. Likewise, the magnetic body portion 20 passes through the insulation layers 17*a* to 17*f* and the insulating substrate 16 in the up-down direction, along the axis Ax2. As such, the magnetic body portion 20 passes through the insides of the coils L5 to L8 in the up-down direction.

Furthermore, the magnetic body layer 18*a* connects the upper end of the magnetic body portion 19 to the upper end of the magnetic body portion 20, and the magnetic body layer 18*b* connects the lower end of the magnetic body portion 19 to the lower end of the magnetic body portion 20. As a result, the magnetic body 22 constituted of the magnetic body layers 18*a* and 18*b* and the magnetic body portions 19 and 20 forms a ring shape when viewed in plan view from the front. Here, the magnetic fluxes produced by the coils L1 to L8 will be considered using a case where a common mode signal is inputted to the coils L1 to L8 as an example.

For example, in the case where the coils L1 to L4 produce a magnetic flux oriented upward with respect to the axis Ax1, the magnetic flux produced by the coils L1 to L4 crosses the magnetic body layer 18*a* toward the left, crosses the magnetic body portion 20 toward the bottom, crosses the magnetic body layer 18*b* toward the right, and then returns to the magnetic body portion 19. In other words, the magnetic flux produced by the coils L1 to L4 circles in a counterclockwise manner, when viewed in plan view from the front.

On the other hand, the coils L5 to L8 produce a magnetic flux oriented downward with respect to the axis Ax2. In this case, the magnetic flux produced by the coils L5 to L8 crosses the magnetic body layer 18*b* toward the right, crosses the magnetic body portion 19 toward the top, crosses the magnetic body layer 18*a* toward the left, and then returns to the magnetic body portion 20. In other words, like the magnetic flux produced by the coils L1 to L4, the magnetic flux produced by the coils L5 to L8 circles in a counterclockwise manner, when viewed in plan view from the front. As such, by arranging the coils L1 to L4 and the coils L5 to L8 in the left-right direction and setting the winding directions of the coils L1 to L4 and the winding directions of the coils L5 to L8 to be opposite directions, the magnetic fluxes produced by the coils L1 to L8 circle in the same direction in the case where a common mode signal is inputted to the coils L1 to L8 through the outer electrodes 14*a* to 14*h*. The magnetic fluxes strengthen each other as a result, and an impedance is produced in response to the common mode signal. The common mode signal is converted into heat and prevented from passing through the coils L1 to L8 as a result. The coils L1 to L8 described thus far form a common mode choke coil.

Meanwhile, the coils L1 to L8 have a structure in which the coils are wound around the magnetic body 22, and thus the respective magnetic fluxes produced by the coils L1 to L8 pass within the ring-shaped magnetic body 22. In other words, a single closed magnetic loop is formed in the magnetic body 22. The magnetic body 22 serves to strongly magnetically couple the coils L1 to L8 as a result.

Meanwhile, in the electronic component 10*a*, the signal Sig1 is applied to the coil L1, the signal Sig2 is applied to the coil L2, the ground potential Vgnd1 is applied to the coil L3, and the power source potential Vacc1 is applied to the coil L4. Accordingly, the coils L1 and L2 to which the signals are applied, the coil L3 to which the ground potential is applied, and the coil L4 to which the power source potential Vacc1 is applied are arranged from top to bottom in that order in the right half of the multilayer body 12. On the other hand, the power source potential Vacc2 is applied to the coil L5, the ground potential Vgnd2 is applied to the coil L6, the signal Sig3 is applied to the coil L7, and the signal Sig4 is applied to the coil L8. Accordingly, the coil L5 to which the power source potential Vacc2 is applied, the coil L6 to which the ground potential is applied, and the coils L7 and L8 to which the signals are applied are arranged from top to bottom in that order in the left half of the multilayer body 12. In other words, the order in which the power source potential, the ground potential, and the signals applied to the coils L1 to L4 are arranged in the up-down direction is the opposite of the order in which the power source potential, the ground potential, and the signals applied to the coils L5 to L8 are arranged in the up-down direction.

(Method of Manufacturing Electronic Component)

A method of manufacturing the electronic component 10*a* will be described hereinafter with reference to the drawings. Although the following describes a case of manufacturing a single electronic component 10*a* as an example, in reality, a large-sized sheet is first laminated to create a mother multilayer body, after which the mother multilayer body is cut in order to manufacture a plurality of electronic components simultaneously.

First, the insulating substrate 16 is irradiated with a laser beam to form through-holes in positions where the via hole conductors v3 and v6 are to be formed.

Next, the coil conductors 28*a*, 28*b*, 34*a*, and 34*b* are formed on the upper surface and the bottom surface, respectively, of the insulating substrate 16, through a Cu subtractive method, a Cu semi-additive method, or the like. Furthermore, the cross-sectional areas of the coil conductors 28*a*, 28*b*, 34*a*, and 34*b* may be increased through electrolytic plating on the surfaces of the coil conductors 28*a*, 28*b*, 34*a*, and 34*b*, in accordance with the allowable current rate required by the coils L3 and L6.

Next, the via hole conductors v3 and v6 are formed by plating the through-holes formed in the insulating substrate 16 with Cu.

Then, the insulation layers 17*c* and 17*d* formed from epoxy resin processed into sheet shapes are respectively layered on the upper surface and the bottom surface of the insulating substrate 16, and subjected to a heating process and a pressurizing process. Note that the thickness of the insulation layers 17*c* and 17*d* is set to a degree that can ensure inter-coil insulation.

Next, the coil conductors 24*b*, 26*b*, and 32*b* and the coil conductors 30*a*, 36*a*, and 38*a* are formed on the upper surface of the insulation layer 17*c* and the bottom surface of the insulation layer 17*d*, respectively, through a Cu subtractive method, a Cu semi-additive method, or the like. A Cu semi-additive method, which is advantageous when fabricating fine wires, is used in the present embodiment.

Next, the insulation layers 17*b* and 17*e* formed from epoxy resin processed into sheet shapes are respectively layered on the upper surface of the insulation layer 17*c* and the bottom surface of the insulation layer 17*d*, and subjected to a heating process and a pressurizing process.

Then, the insulation layers 17*b* and 17*e* are irradiated with a laser beam to form through-holes in positions where the via hole conductors v1, v2, v4, v5, v7, and v8 are to be formed.

Next, the coil conductors 24*a*, 26*a*, and 32*a* and the coil conductors 30*b*, 36*b*, and 38*b* are formed on the upper surface of the insulation layer 17*b* and the bottom surface of the insulation layer 17*e*, respectively, through a Cu subtractive method, a Cu semi-additive method, or the like. A Cu semi-additive method, which is advantageous when fabricating fine wires, is used in the present embodiment.

Next, the via hole conductors v1, v2, v4, v5, v7, and v8 are formed by plating the through-holes formed in the insulation layers 17*b* and 17*e* with Cu.

Next, the insulation layers 17*a* and 17*f* formed from epoxy resin processed into sheet shapes are respectively layered on the upper surface of the insulation layer 17*b* and the bottom surface of the insulation layer 17*e*, and subjected to a heating process and a pressurizing process.

Next, using a photographic method, a resist having openings only in parts where the holes H21 and H28 are to be formed is formed on the upper surface of the insulation layer 17*a*, and a resist having openings only in parts where the holes H27 and H34 are to be formed is formed on the bottom surface of the insulation layer 17*f*. The holes H21 to H34 are then formed through a blasting method. Note that the holes H21 to H34 may be formed through a drilling process, a laser process, or the like.

Next, the magnetic body portions 19 and 20 are formed by filling the holes H21 to H34 with a mixture of a metal magnetic body and an epoxy resin.

Then, the magnetic body layers 18*a* and 18*b* created from a mixture of a metal magnetic body and an epoxy resin are layered on the upper surface of the insulation layer 17*a* and the bottom surface of the insulation layer 17*f*, respectively, and subjected to a heating process and a pressurizing process. The mother multilayer body is obtained as a result.

Next, the mother multilayer body is cut using a dicer to obtain a plurality of the multilayer bodies 12. The multilayer bodies 12 may be beveled through barrel finishing.

Finally, base electrodes for the outer electrodes 14*a* to 14*p* are formed by applying a conductive paste having silver or the like as its primary component to the upper surface of the multilayer body 12. The outer electrodes 14*a* to 14*p* are formed by then plating the base electrodes with Ni and Zn. The electronic component 10*a* is completed through the process described thus far.

(Effects)

According to the electronic component 10*a* of the present embodiment, the electronic component 10*a* can be reduced in size. To be more specific, the ferrite core disclosed in Japanese Unexamined Patent Application Publication No. H02-91903 surrounds the periphery of a thick cable in which an outer conductor and a covering are provided in the periphery of a signal line. Furthermore, in the case where this ferrite core is to be mounted in an electronic device, it is necessary to attach the ferrite core to the cable within the electronic device. A large space is therefore required to place the ferrite core, which makes it difficult to use the ferrite core in an electronic device.

However, according to the electronic component 10*a*, the coils L1 to L8 that form a common mode choke coil are provided in the multilayer body 12. In the case where the electronic component 10*a* is to be mounted in an electronic device, for example, the electronic component 10*a* may be mounted on a circuit board and connected to signal lines of the circuit board. In other words, it is not necessary to provide the electronic component 10*a* in the periphery of a thick cable. The electronic component 10*a* can therefore be placed in tight spaces within the electronic device.

Furthermore, the electronic component 10*a* can reduce the height in the up-down direction (called reducing the profile hereinafter). Hereinafter, an electronic component in which the coils L1 to L8 are arranged in a single row in the up-down direction will be discussed as an electronic component according to a comparative example. In the electronic component according to the comparative example, the coils L1 to L8 are arranged in a single row in the up-down direction, which increases the height in the up-down direction and makes it difficult to reduce the profile.

Accordingly, in the electronic component 10*a*, the coils L5 and L6 wind around the axis Ax2 when viewed in plan view from above, and the coil L1 winds around the axis Ax1, which is different from the axis Ax2, when viewed in plan view from above. In other words, the coils L5 and L6 and the coil L1 are arranged in the left-right direction. As a result, the region where the coil L1 is provided can overlap, in the up-down direction, with the region where the coil L5 is provided. In the electronic component 10*a*, the region where the coil L1 is provided matches the region where the coil L5 is provided in the up-down direction. This makes it possible to reduce the profile of the electronic component 10*a*.

Meanwhile, the center axes of the coils L1 to L4 match, which makes it possible to increase a degree of coupling among the coils L1 to L4. As such, the impedance relative to the common mode signal can be increased in the coils L1 to L4. Likewise, the center axes of the coils L5 to L8 match, which makes it possible to increase a degree of coupling among the coils L5 to L8. As such, the impedance relative to the common mode signal can be increased in the coils L5 to L8.

In addition, the coil conductors 24*a* and 24*b* that form the coil L1 are provided on the same upper surfaces of the insulation layers 17*b* and 17*c* as the coil conductors 26*a* and 26*b* that form the coil L2, respectively. As a result, the distance between the coil L1 and the coil L2 can be reduced and the degree of coupling between the coil L1 and the coil L2 can be increased. As such, the impedance relative to the common mode signal can be increased in the coils L1 and L2. Note that the same applies to the coils L7 and L8 as to the coils L1 and L2.

Furthermore, the coil conductor 24*a* and the coil conductor 26*a* run parallel along their entire lengths. Likewise, the coil conductor 24*b* and the coil conductor 26*b* run parallel along their entire lengths. As a result, the degree of coupling between the coil L1 and the coil L2 can be increased. As such, the impedance relative to the common mode signal can be increased in the coils L1 and L2. In addition, the coil L1 and the coil L2 can be provided with closer electrical characteristics such as resistance value, inductance value, and so on. Note that the same applies to the coils L7 and L8 as to the coils L1 and L2.

In addition, in the electronic component 10*a*, the magnetic body 22 serves to magnetically couple the coils L1 to L8. Accordingly, the degree of coupling in the coils L1 to L8 increases, which makes it possible to increase the impedance relative to the common mode signal in the coils L1 to L8.

Furthermore, in the electronic component 10*a*, the magnetic body portion 19 passes through the coils L1 to L4 and the magnetic body portion 20 passes through the coils L5 to L8. Furthermore, the magnetic body layer 18*a* connects the upper end of the magnetic body portion 19 to the upper end of the magnetic body portion 20, and the magnetic body layer 18*b* connects the lower end of the magnetic body portion 19 to the lower end of the magnetic body portion 20. Accordingly, the magnetic body 22 forms a ring shape, and a closed magnetic loop is formed in the magnetic body 22. As a result, the degree of coupling in the coils L1 to L8 increases, which makes it possible to increase the impedance relative to the common mode signal in the coils L1 to L8.

Furthermore, in the electronic component 10*a*, the surface area of a cross-section of the magnetic body portion 19 orthogonal to the up-down direction is substantially equal to the surface area of a cross-section of the magnetic body portion orthogonal to the up-down direction. Accordingly, the inductance value of the coils L1 to L4 and the inductance value of the coils L5 to L8 can be brought closer to each other. In other words, variation in the impedances relative to the common mode signal can be suppressed in the coils L1 to L8.

Meanwhile, the power source potentials Vacc1 and Vacc2 are applied to the coils L4 and L5, respectively, and the ground potentials Vgnd1 and Vgnd2 are applied to the coils L3 and L6, respectively. On the other hand, the signals Sig1 to Sig4 are applied to the coils L1, L2, L7, and L8, respectively. Accordingly, a greater current flows in the coils L3 to L6 than in the coils L1, L2, L7, and L8. The line width W2 of the coils L3 to L6 is therefore greater than the line width W1 of the coils L1, L2, L7, and L8. This results in the coils L3 to L6 having a lower resistance value than the resistance value of the coils L1, L2, L7, and L8. The allowable current value of the electronic component 10*a* can therefore be increased.

Meanwhile, the ground potentials Vgnd1 and Vgnd2 are applied to the coils L3 and L6, respectively. On the other hand, the signals Sig1 to Sig4 are applied to the coils L1, L2, L7, and L8, respectively. Accordingly, a greater current flows in the coils L3 and L6 than in the coils L1, L2, L7, and L8. The thickness D2 of the coils L3 and L6 is therefore greater than the thickness D1 of the coils L1, L2, L7, and L8. This results in the coils L3 and L6 having a lower resistance value than the resistance value of the coils L1, L2, L7, and L8. The allowable current value of the electronic component 10*a* can therefore be increased.

Meanwhile, as described above, in the electronic component 10*a*, the order in which the power source potential, the ground potential, and the signals applied to the coils L1 to L4 are arranged in the up-down direction is the opposite of the order in which the power source potential, the ground potential, and the signals applied to the coils L5 to L8 are arranged in the up-down direction. This makes it possible to bring a magnetic flux density distribution in the coils L1 to L4 and a magnetic flux density distribution in the coils L5 to L8 closer to each other. The coils L1 to L8 can be provided with closer electrical characteristics such as inductance value as a result, which in turn makes it possible to suppress variation in the impedance relative to the common mode signal in the coils L1 to L8.

(First Variation)

Figure 5A:
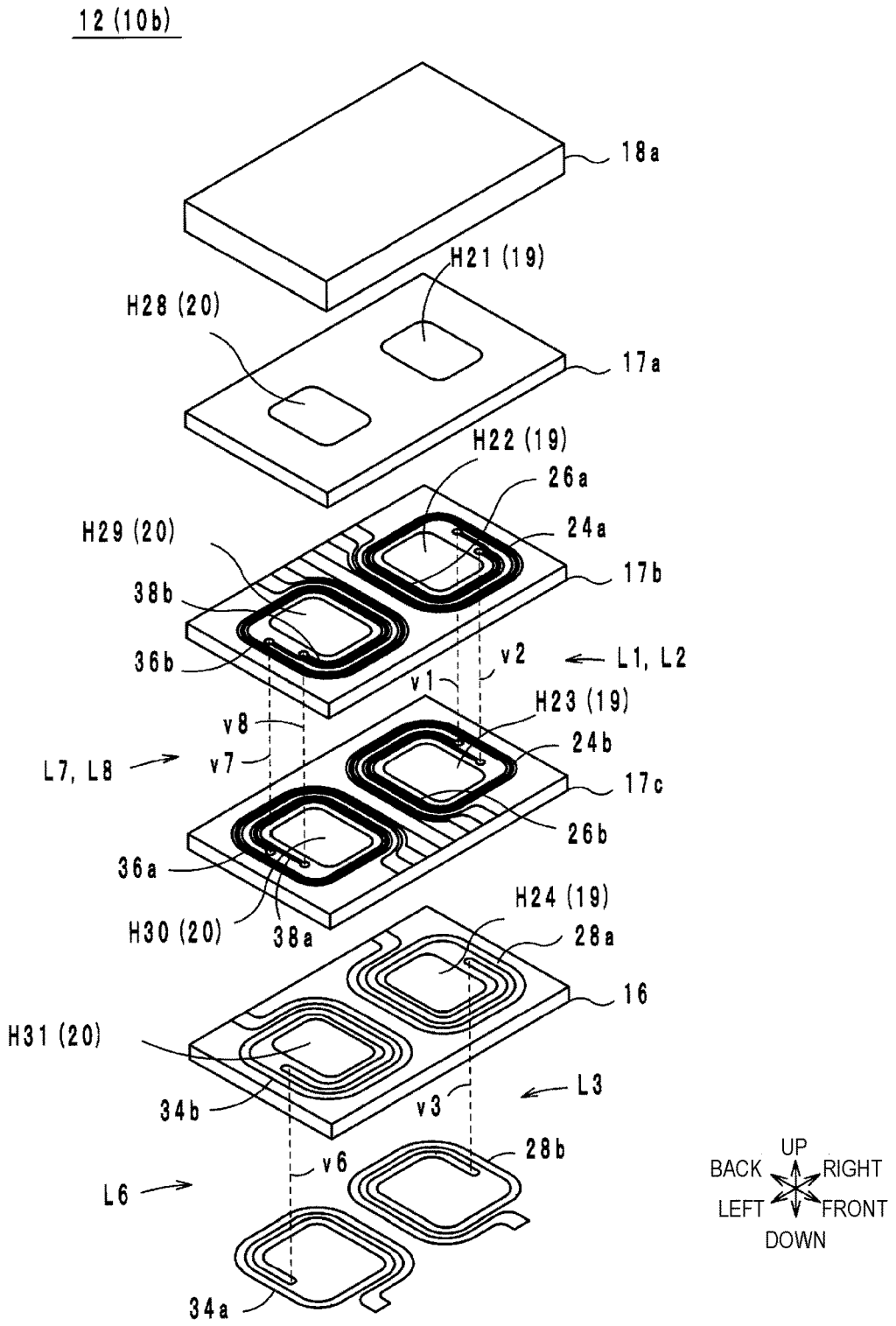
FIG. 5A is an exploded perspective view illustrating a multilayer body 12 of the electronic component 10*b*.
Figure 5B:
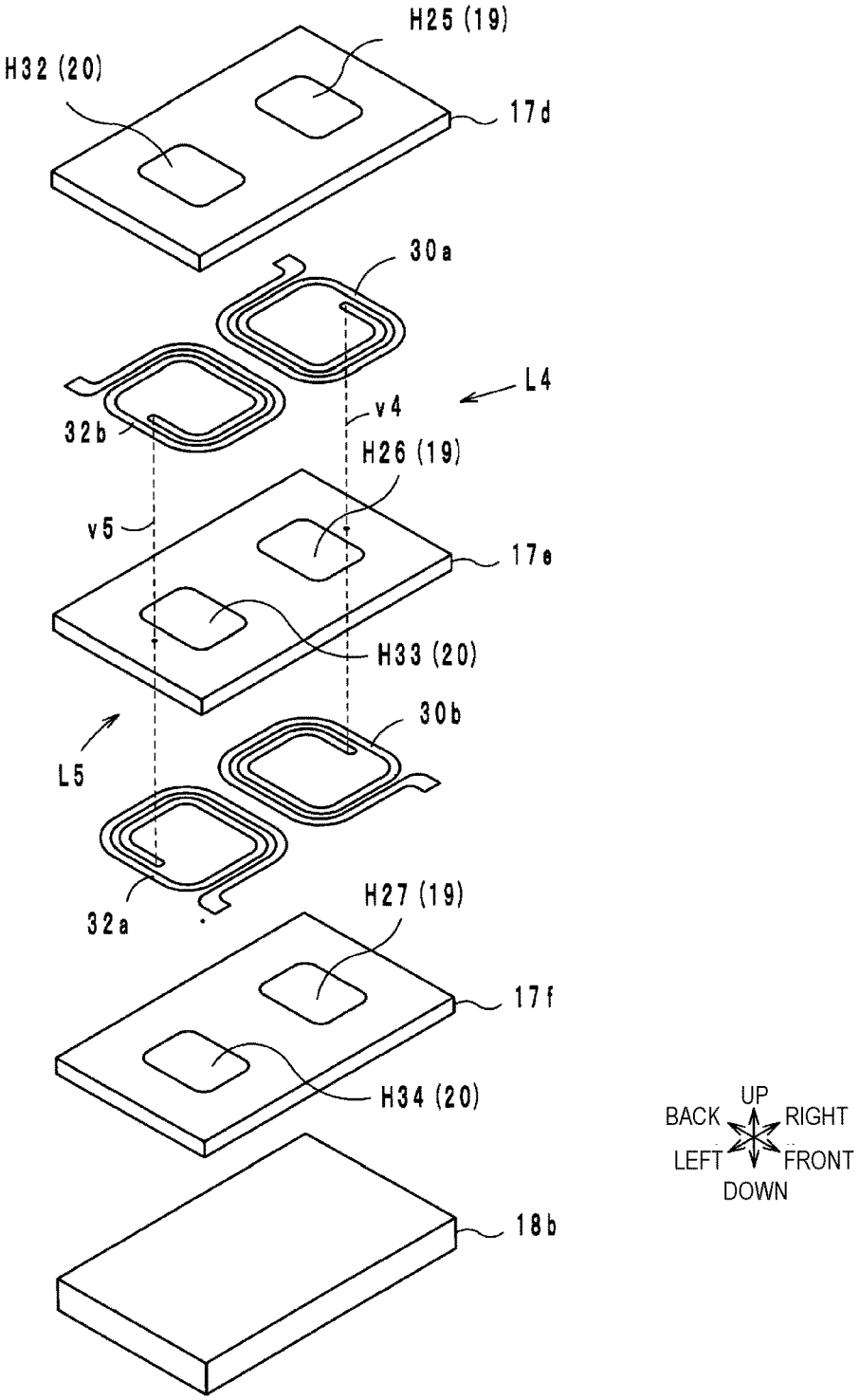
FIG. 5B is an exploded perspective view illustrating the multilayer body 12 of the electronic component 10*b*.

Next, an electronic component 10*b* according to a first variation will be described with reference to the drawings. FIGS. 5A and 5B are exploded perspective views illustrating the multilayer body 12 of the electronic component 10*b*. Note that FIG. 1 will be employed as an external perspective view of the electronic component 10*b*.

The electronic component 10*b* differs from the electronic component 10*a* in the placement of the coils L5 to L8. The electronic component 10*b* will be described next, focusing on this difference.

In the electronic component 10*b*, the region where the coil L5 is provided matches the region where the coil L4 is provided in the up-down direction. To be more specific, the coil conductor 32*a* of the coil L5 is provided on the bottom surface of the insulation layer 17*e*. The coil conductor 32*b* of the coil L5 is provided on the bottom surface of the insulation layer 17*d*. The via hole conductor v5 of the coil L5 is provided in the insulation layer 17*e*. Accordingly, the coil conductor 32*a* and the coil conductor 30*b* have, on the bottom surface of the insulation layer 17*e*, a substantially linearly symmetrical structure with respect to a perpendicular bisector between the axis Ax1 and the axis Ax2. Likewise, the coil conductor 32*b* and the coil conductor 30*a* have, on the bottom surface of the insulation layer 17*d*, a substantially linearly symmetrical structure with respect to the perpendicular bisector between the axis Ax1 and the axis Ax2.

Meanwhile, the region where the coil L6 is provided matches, in the up-down direction, the region where the coil L3 is provided. To be more specific, the coil conductor 34*a* of the coil L6 is provided on the bottom surface of the insulating substrate 16. The coil conductor 34*b* of the coil L6 is provided on the upper surface of the insulating substrate 16. The via hole conductor v6 of the coil L6 is provided in the insulating substrate 16. Accordingly, the coil conductor 34*a* and the coil conductor 28*b* have, on the bottom surface of the insulating substrate 16, a substantially linearly symmetrical structure with respect to the perpendicular bisector between the axis Ax1 and the axis Ax2. Likewise, the coil conductor 34*b* and the coil conductor 28*a* have, on the upper surface of the insulating substrate 16, a substantially linearly symmetrical structure with respect to the perpendicular bisector between the axis Ax1 and the axis Ax2.

Meanwhile, the regions where the coils L7 and L8 are provided matches, in the up-down direction, the regions where the coils L1 and L2 are provided. To be more specific, the coil conductors 36*a* and 38*a* of the coils L7 and L8 are provided on the upper surface of the insulation layer 17*c*. The coil conductors 36*b* and 38*b* of the coils L7 and L8 are provided on the upper surface of the insulation layer 17*b*. The via hole conductors v7 and v8 of the coils L7 and L8 are provided in the insulation layer 17*b*. Accordingly, the coil conductor 36*a* and the coil conductor 24*b* have, on the upper surface of the insulation layer 17*c*, a substantially linearly symmetrical structure with respect to the perpendicular bisector between the axis Ax1 and the axis Ax2. The coil conductor 38*a* and the coil conductor 26*b* have, on the upper surface of the insulation layer 17*c*, a substantially linearly symmetrical structure with respect to the perpendicular bisector between the axis Ax1 and the axis Ax2. Likewise, the coil conductor 36*b* and the coil conductor 24*a* have, on the upper surface of the insulation layer 17*b*, a substantially linearly symmetrical structure with respect to the perpendicular bisector between the axis Ax1 and the axis Ax2. The coil conductor 38*b* and the coil conductor 26*a* have, on the upper surface of the insulation layer 17*b*, a substantially linearly symmetrical structure with respect to the perpendicular bisector between the axis Ax1 and the axis Ax2.

In the electronic component 10*b*, the signals Sig1 and Sig2 are applied to the coils L1 and L2, respectively. The ground potentials Vgnd1 and Vgnd2 are applied to the coils L3 and L4, respectively. The power source potentials Vacc1 and Vacc2 are applied to the coils L5 and L6, respectively. The signals Sig3 and Sig4 are applied to the coils L7 and L8, respectively.

In the electronic component 10*b* described thus far, the electrical characteristics such as resistance value and inductance value of the coil L1 are substantially the same as the electrical characteristics such as resistance value and inductance value of the coil L7, the electrical characteristics such as resistance value and inductance value of the coil L2 are substantially the same as the electrical characteristics such as resistance value and inductance value of the coil L8, the electrical characteristics such as resistance value and inductance value of the coil L3 are substantially the same as the electrical characteristics such as resistance value and inductance value of the coil L6, and the electrical characteristics such as resistance value and inductance value of the coil L4 are substantially the same as the electrical characteristics such as resistance value and inductance value of the coil L5. As a result, variation in the impedance relative to the common mode signal can be suppressed in the coils L1 to L8.

(Second Variation)

Figure 6:
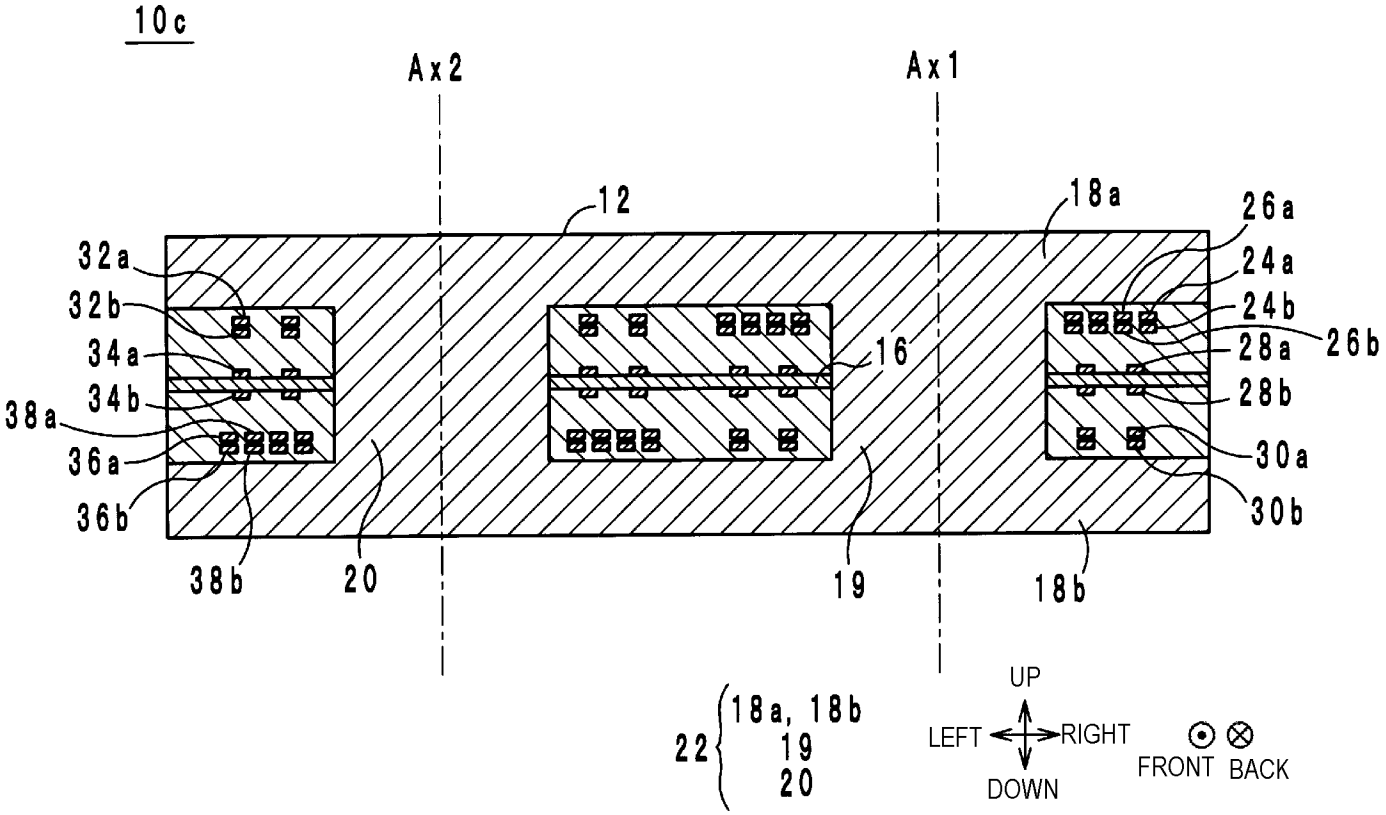
FIG. 6 is a cross-sectional structural diagram illustrating the electronic component 10*c* illustrated in FIG. 1 along a 3-3 line.

Next, an electronic component 10*c* according to a second variation will be described with reference to the drawings. FIG. 6 is a cross-sectional structural diagram illustrating the electronic component 10*c* illustrated in FIG. 1 along a 3-3 line. Note that FIG. 1 will be employed as an external perspective view of the electronic component 10*c*.

The electronic component 10*c* differs from the electronic component 10*a* in terms of the line width of the coil conductors 30*a*, 30*b*, 32*a*, and 32*b*, as well as the thickness and line width of the coil conductors 28*a*, 28*b*, 34*a*, and 34*b*. The electronic component 10*c* will be described next, focusing on these differences.

In the electronic component 10*c*, the line width of the coil conductors 30*a*, 30*b*, 32*a*, and 32*b* is substantially the same width W1 as the line width of the coil conductors 24*a*, 24*b*, 26*a*, 26*b*, 36*a*, 36*b*, 38*a*, and 38*b*.

In the electronic component 10*c*, the thickness of the coil conductors 28*a*, 28*b*, 34*a*, and 34*b* is substantially the same thickness D1 as the thickness of the coil conductors 24*a*, 24*b*, 26*a*, 26*b*, 30*a*, 30*b*, 32*a*, 32*b*, 36*a*, 36*b*, 38*a*, and 38*b*. The line width of the coil conductors 28*a*, 28*b*, 34*a*, and 34*b* is substantially the same width W1 as the line width of the coil conductors 24*a*, 24*b*, 26*a*, 26*b*, 36*a*, 36*b*, 38*a*, and 38*b*.

In the electronic component 10*c* described thus far, the structures of the coils L1 to L8 can be made more similar to each other, and thus the electrical characteristics of the coils L1 to L8 can be brought closer to each other. As a result, variation in the impedance relative to the common mode signal can be suppressed in the coils L1 to L8.

Note that it is sufficient for either the thickness of the coil conductors 28*a*, 28*b*, 34*a*, and 34*b* to be the thickness D1, or for the line width of the coil conductors 28*a*, 28*b*, 34*a*, and 34*b* to be the width W1, as well.

In the electronic component 10*c* described thus far, the electrical characteristics such as resistance value and inductance value of the coils L1 to L8 are substantially the same. In other words, the inductance values of the coils L1 to L8 are substantially the same, and the degrees of coupling in the coils L1 to L8 are also substantially the same. As a result, variation in the impedance relative to the common mode signal can be suppressed in the coils L1 to L8.

(Third Variation)

Figure 7A:
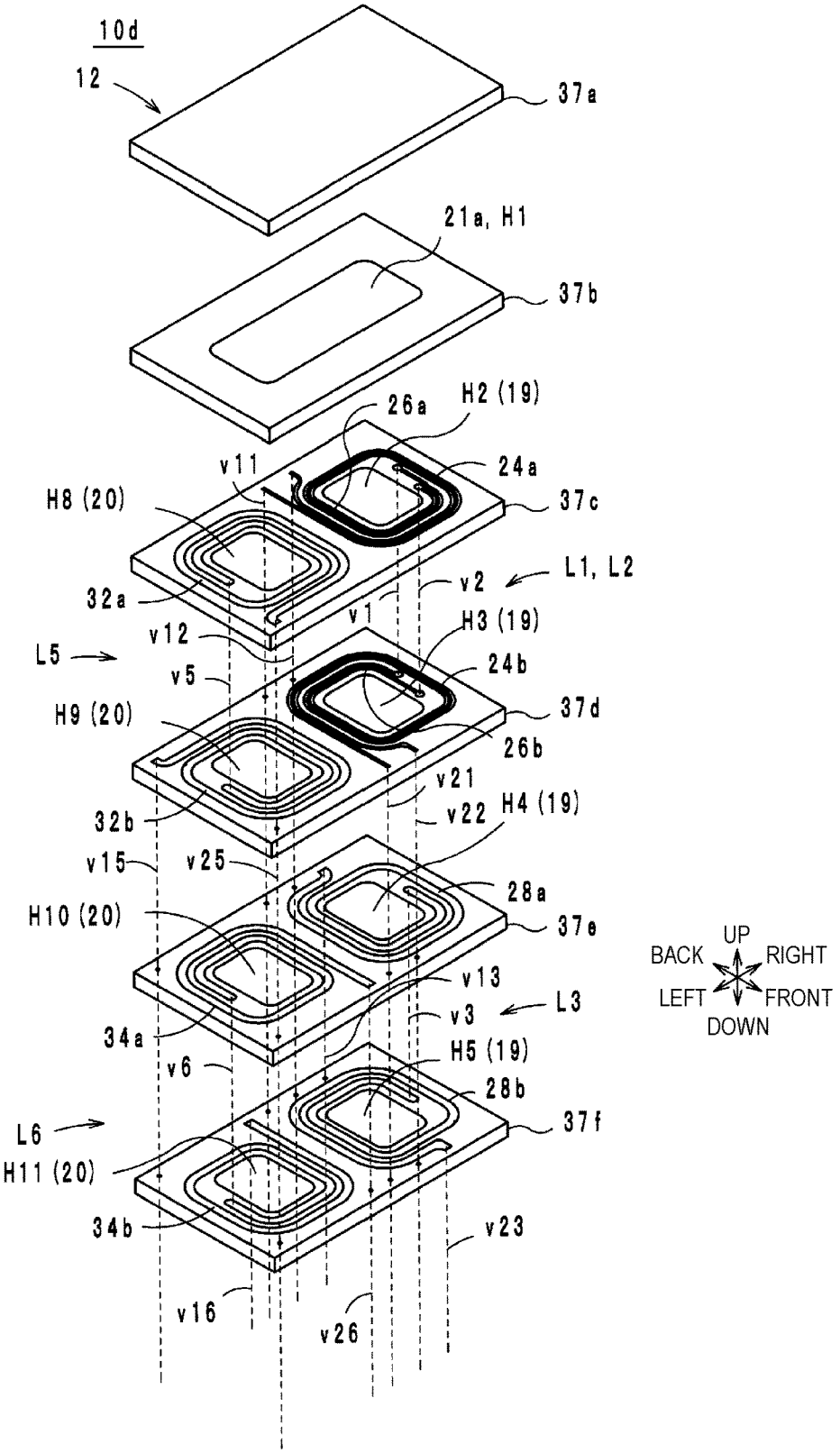
FIG. 7A is an exploded perspective view illustrating a multilayer body 12 of an electronic component 10*d*.
Figure 7B:
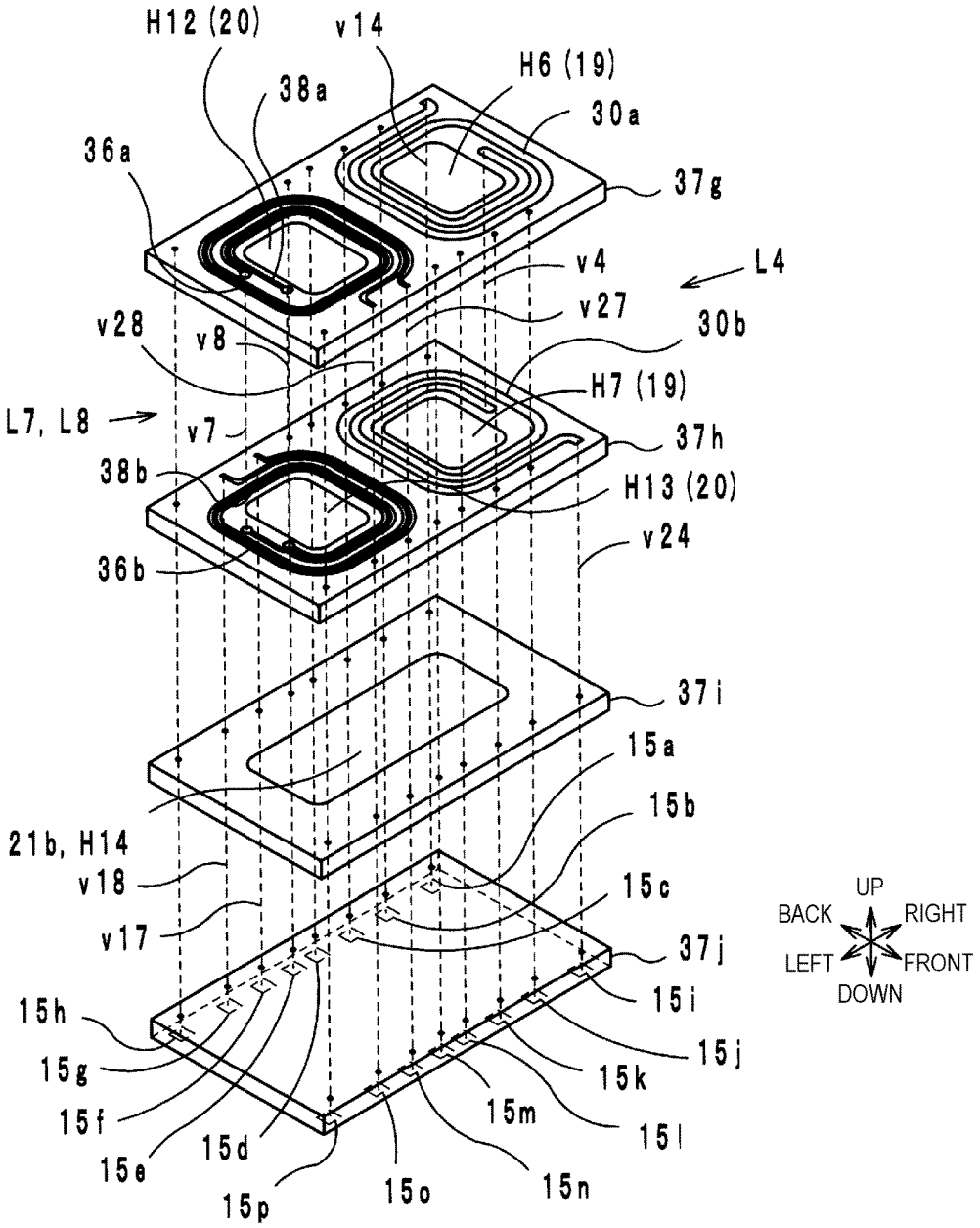
FIG. 7B is an exploded perspective view illustrating the multilayer body 12 of the electronic component 10*d*.
Figure 8:
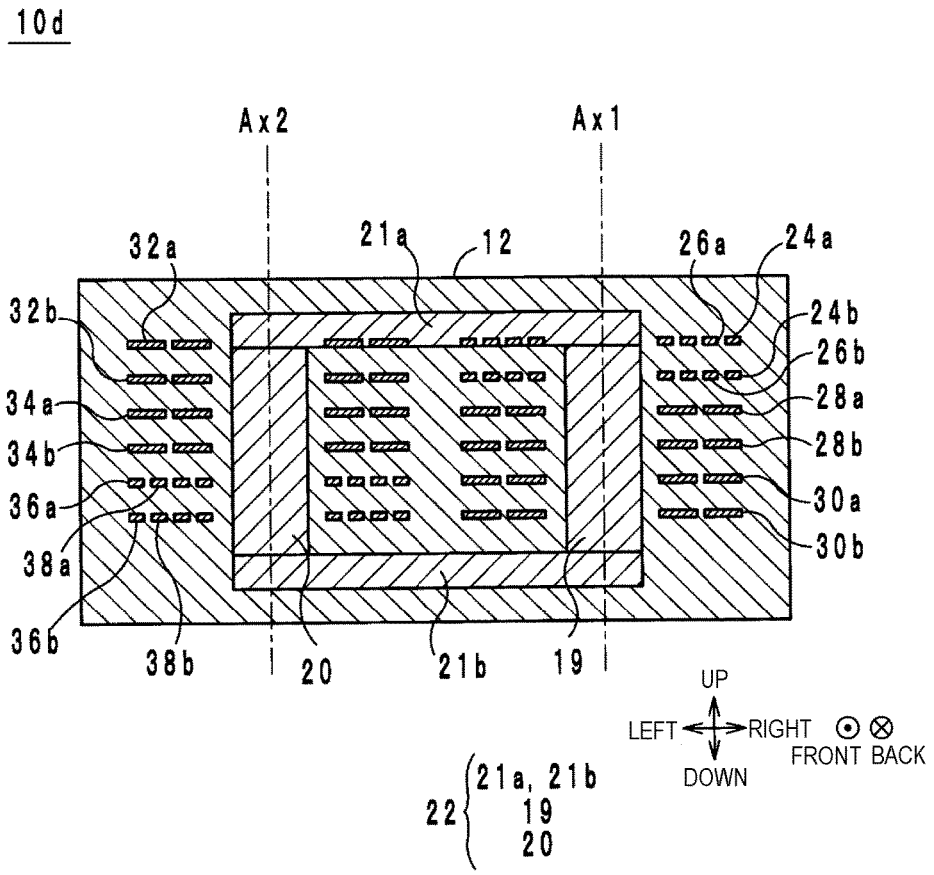
FIG. 8 is a cross-sectional structural diagram illustrating the electronic component 10*d*.

Next, an electronic component 10*d* according to a third variation will be described with reference to the drawings. FIGS. 7A and 7B are exploded perspective views illustrating the multilayer body 12 of the electronic component 10*d*. FIG. 8 is a cross-sectional structural diagram illustrating the electronic component 10*d*.

The electronic component 10*d* differs from the electronic component 10*a* in terms of the following differences 1 to 5.

Difference 1: insulation layers 37*a* to 37*j* are used instead of the insulating substrate 16 and the insulation layers 17*a* to 17*f*, Difference 2: the coil conductors 24*a*, 24*b*, 26*a*, 26*b*, 28*a*, 28*b*, 30*a*, 30*b*, 32*a*, 32*b*, 34*a*, 34*b*, 36*a*, 36*b*, 38*a*, and 38*b* are not drawn out to the longer sides on the front and back of the insulation layers 37*a* to 37*f*, Difference 3: outer electrodes 15*a* to 15*p* are provided instead of the outer electrodes 14*a* to 14*p*, Difference 4: via hole conductors v11 to v18 and v21 to v28 are provided, and Difference 5: the magnetic body 22 is constituted of magnetic body portions 19, 20, 21*a*, and 21*b*.

First, difference 1 will be described. The multilayer body 12 is layered so that the insulation layers 37*a* to 37*j* are arranged in that order from top to bottom. The insulation layers 37*a* to 37*j* are flexible sheets formed from a thermoplastic resin (a liquid-crystal polymer, for example). Accordingly, the multilayer body 12 is also flexible.

Holes H2 to H7, which have rectangular shapes, are provided near the respective centers (the points of intersection between diagonal lines) of right-half regions of the insulation layers 37*c* to 37*h*, when viewed in plan view from above. The holes H2 to H7 match and overlap when viewed in plan view from above. Meanwhile, holes H8 to H13, which have rectangular shapes, are provided near the respective centers (the points of intersection between diagonal lines) of left-half regions of the insulation layers 37*c* to 37*h*, when viewed in plan view from above. The holes H8 to H13 match and overlap when viewed in plan view from above.

Holes H1 and H14, which have rectangular shapes and are longer in the left-right direction, are provided in the insulation layers 37*b* and 37*i*. The holes H1 and H14 overlap with both the holes H2 to H7 and the holes H8 to H13 when viewed in plan view from above.

Next, difference 2 will be described. In the electronic component 10*d*, the coil conductors 24*a*, 24*b*, 26*a*, 26*b*, 28*a*, 28*b*, 30*a*, 30*b*, 32*a*, 32*b*, 34*a*, 34*b*, 36*a*, 36*b*, 38*a*, and 38*b* are not drawn out to the longer sides on the front and back of the insulation layers 37*a* to 37*f*. Accordingly, the upstream ends of the coil conductors 24*a*, 26*a*, 28*a*, 30*a*, 32*b*, 34*b*, 36*b*, and 38*b* are positioned slightly more forward than the longer side on the back of the insulation layers 37*c* to 37*h*. Likewise, the downstream end of the coil conductors 24*b*, 26*b*, 28*b*, 30*b*, 32*a*, 34*a*, 36*a*, and 38*a* are positioned slightly more rearward than the longer side on the front of the insulation layers 37*c* to 37*h*.

Next, difference 3 will be described. In the electronic component 10*d*, the outer electrodes 15*a* to 15*p* are provided on the bottom surface of the multilayer body 12, and have rectangular shapes. The outer electrodes 15*a* to 15*h* are provided on a bottom surface of the insulation layer 37*j*, arranged in that order from right to left along the longer side on the back of the insulation layer 37*j*. The outer electrodes 15*i* to 15*p* are provided on the bottom surface of the insulation layer 37*j*, arranged in that order from right to left along the longer side on the front of the insulation layer 37*j*.

Next, difference 4 will be described. In the electronic component 10*d*, the via hole conductors v11 to v18 and v21 to v28 that extend in the up-down direction are provided in the multilayer body 12. The via hole conductor v11 passes through the insulation layers 37*c* to 37*j* in the up-down direction and connects the upstream end of the coil conductor 24*a* to the outer electrode 15*d*. The via hole conductor v12 passes through the insulation layers 37*c* to 37*j* in the up-down direction and connects the upstream end of the coil conductor 26*a* to the outer electrode 15*c*. The via hole conductor v13 passes through the insulation layers 37*e* to 37*j* in the up-down direction and connects the upstream end of the coil conductor 28*a* to the outer electrode 15*b*. The via hole conductor v14 passes through the insulation layers 37*g* to 37*j* in the up-down direction and connects the upstream end of the coil conductor 30*a* to the outer electrode 15*a*. The via hole conductor v15 passes through the insulation layers 37*d* to 37*j* in the up-down direction and connects the upstream end of the coil conductor 32*b* to the outer electrode 15*h*. The via hole conductor v16 passes through the insulation layers 37*f* to 37*j* in the up-down direction and connects the upstream end of the coil conductor 34*b* to the outer electrode 15*e*. The via hole conductor v17 passes through the insulation layers 37*h* to 37*j* in the up-down direction and connects the upstream end of the coil conductor 36*b* to the outer electrode 15*f*. The via hole conductor v18 passes through the insulation layers 37*h* to 37*j* in the up-down direction and connects the upstream end of the coil conductor 38*b* to the outer electrode 15*g*.

The via hole conductor v21 passes through the insulation layers 37*d* to 37*j* in the up-down direction and connects the downstream end of the coil conductor 24*b* to the outer electrode 151. The via hole conductor v22 passes through the insulation layers 37*d* to 37*j* in the up-down direction and connects the downstream end of the coil conductor 26*b* to the outer electrode 15*k*. The via hole conductor v23 passes through the insulation layers 37*f* to 37*j* in the up-down direction and connects the downstream end of the coil conductor 28*b* to the outer electrode 15*j*. The via hole conductor v24 passes through the insulation layers 37*h* to 37*j* in the up-down direction and connects the downstream end of the coil conductor 30*b* to the outer electrode 15*i*. The via hole conductor v25 passes through the insulation layers 37*c* to 37*j* in the up-down direction and connects the downstream end of the coil conductor 32*a* to the outer electrode 15*p*. The via hole conductor v26 passes through the insulation layers 37*e* to 37*j* in the up-down direction and connects the downstream end of the coil conductor 34*a* to the outer electrode 15*m*. The via hole conductor v27 passes through the insulation layers 37*g* to 37*j* in the up-down direction and connects the downstream end of the coil conductor 36*a* to the outer electrode 15*n*. The via hole conductor v28 passes through the insulation layers 37*g* to 37*j* in the up-down direction and connects the downstream end of the coil conductor 38*a* to the outer electrode 15*o*.

Next, difference 5 will be described. In the electronic component 10*d*, the magnetic body 22 is constituted of the magnetic body portions 19, 20, 21*a*, and 21*b*. The magnetic body portion 19 is a prismatic member extending in the up-down direction, and is inserted into the holes H2 to H7. The magnetic body portion 20 is a prismatic member extending in the up-down direction, and is inserted into the holes H8 to H13.

The magnetic body portion 21*a* is a plate-shaped member having a rectangular shape when viewed in plan view from above, and is provided within the hole H1. Accordingly, the magnetic body portion 21*a* is connected to the upper ends of the magnetic body portions 19 and 20. The magnetic body portion 21*b* is a plate-shaped member having a rectangular shape when viewed in plan view from above, and is provided within the hole H14. Accordingly, the magnetic body portion 21*b* is connected to the lower ends of the magnetic body portions 19 and 20. The magnetic body 22 is formed from Ni—Fe spinel ferrite. Although the magnetic body 22 may be formed from a metal, it is preferable that the magnetic body 22 be formed from a ferrite or a highly-insulative material obtained by covering the surface of a metal portion with an insulative resin, from the standpoint of insulation properties.

(Method of Manufacturing Electronic Component)

A method of manufacturing the electronic component 10*d* will be described next with reference to the drawings. FIGS. 9A to 9G and 10 are cross-sectional views illustrating steps in the manufacture of the electronic component 10*d*.

The coil conductors 24*a*, 24*b*, 26*a*, 26*b*, 28*a*, 28*b*, 30*a*, 30*b*, 32*a*, 32*b*, 34*a*, 34*b*, 36*a*, 36*b*, 38*a*, and 38*b*, as well as the via hole conductors v1 to v8, v11 to v18, and v21 to v28, are formed on the upper surfaces of sheets 137*c* to 137*h* (only the sheet 137*g* is illustrated in FIGS. 9A to 9G) that are to become the insulation layers 37*c* to 37*h*. Furthermore, the holes H2 to H7 and H8 to H13 are formed in the sheets 137*c* to 137*h*. The sheet 137*g* will be described as an example hereinafter.

Figure 9A:
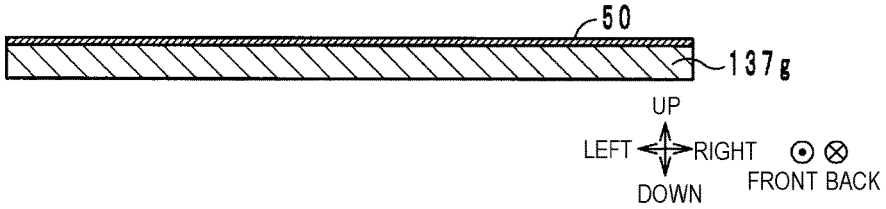
FIG. 9A is a cross-sectional view illustrating a step in the manufacture of the electronic component 10*d*.

First, as illustrated in FIG. 9A, the sheet 137*g*, constituted of a thermoplastic resin on the entire upper surface of which a metal film 50 has been formed, is prepared. Specifically, a copper foil is applied to the upper surface of the sheet 137*g*. Furthermore, the surface of the copper foil on the sheet 137*g* is, for example, galvanized to prevent rust and then smoothed, thus forming the metal film 50. The sheet 137*g* is a liquid-crystal polymer. The metal film 50, meanwhile, is 10 μm to 20 μm thick.

Figure 9B:
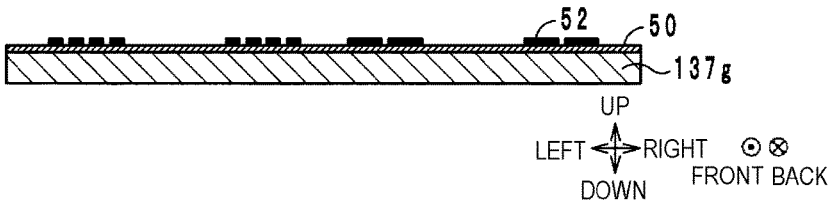
FIG. 9B is a cross-sectional view illustrating a step in the manufacture of the electronic component 10*d*.
Figure 9C:
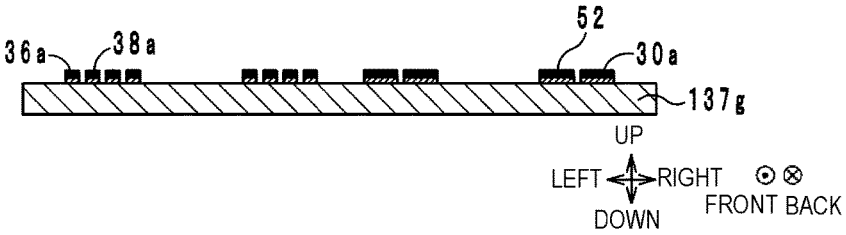
FIG. 9C is a cross-sectional view illustrating a step in the manufacture of the electronic component 10*d*.
Figure 9D:
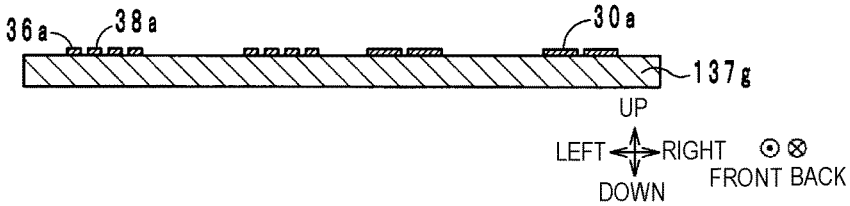
FIG. 9D is a cross-sectional view illustrating a step in the manufacture of the electronic component 10*d*.

Next, as illustrated in FIG. 9B, a resist 52 having the same shape as the coil conductors 30*a*, 36*a*, and 38*a* is applied to the metal film 50 of the sheet 137*g*. Then, as illustrated in FIG. 9C, the metal film 50 is removed from parts not covered by the resist by subjecting the metal film 50 to an etching process. The coil conductors 30*a*, 36*a*, and 38*a* are formed as a result. Furthermore, as illustrated in FIG. 9D, the resist 52 is removed by spraying the resist with a resist removal liquid.

Figure 9E:
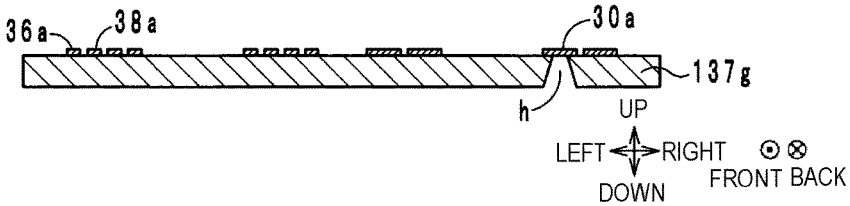
FIG. 9E is a cross-sectional view illustrating a step in the manufacture of the electronic component 10*d*.
Figure 9F:
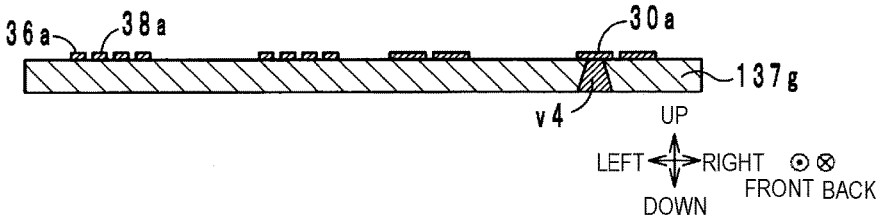
FIG. 9F is a cross-sectional view illustrating a step in the manufacture of the electronic component 10*d*.
Figure 9G:
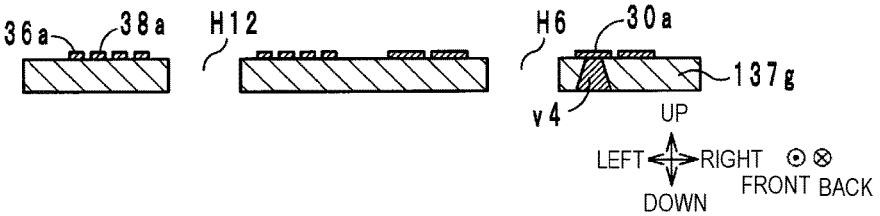
FIG. 9G is a cross-sectional view illustrating a step in the manufacture of the electronic component 10*d*.

Next, as illustrated in FIG. 9E, a through-hole h is formed by irradiating a position on the rear side of the sheet 137*g*, in a location where the via hole conductors v4, v7, v8, v11 to v16, v21 to v23, and v25 to v28 are to be formed, with a laser beam. Then, as illustrated in FIG. 9F, the through-hole h is filled with a conductive paste in order to form the via hole conductors v4, v7, v8, v11 to v16, v21 to v23, and v25 to v28.

Next, the holes H6 and H12 are formed in the sheet 137*g* through a punching process or a laser process. The sheet 137*g*, in which the coil conductors 30*a*, 36*a*, and 38*a*, the via hole conductors v4, v7, v8, v11 to v16, v21 to v23, and v25 to v28, and the holes H6 and H12 are formed, is obtained as a result. Note that the same processing as that performed on the sheet 137*g* is performed on the sheets 137*c* to 137*f* as well.

Next, the hole H1 is formed in the sheet 137*b* that is to become the insulation layer 37*b* through a punching process or a laser process.

Next, the via hole conductors v11 to v18 and v21 to v28 are formed in the sheet 137*i* that is to become the insulation layer 37*i*. The hole H14 is formed through a punching process or a laser process. The process for forming the via hole conductors v11 to v18 and v21 to v28 in the sheet 137*i* is the same as the process for forming v4, v7, v8, v11 to v16, v21 to v23, and v25 to v28 in the sheet 137*g*, and thus descriptions thereof will be omitted.

Next, the outer electrodes 15*a* to 15*p*, as well as the via hole conductors v11 to v18 and v21 to v28, are formed on a bottom surface of the sheet 137*j* that is to become the insulation layer 37*j*. The process for forming the outer electrodes 15*a* to 15*p* on the bottom surface of the sheet 137*j* is the same as the process for forming the coil conductors 30*a*, 36*a*, and 38*a* on the upper surface of the sheet 137*g*, and thus descriptions thereof will be omitted. Likewise, aside from irradiating the sheet 137*j* with a laser beam from the upper surface, the process for forming the via hole conductors v11 to v18 and v21 to v28 in the sheet 137*j* is the same as the process for forming v4, v7, v8, v11 to v16, v21 to v23, and v25 to v28 in the sheet 137*g*, and thus descriptions thereof will be omitted.

Figure 10:
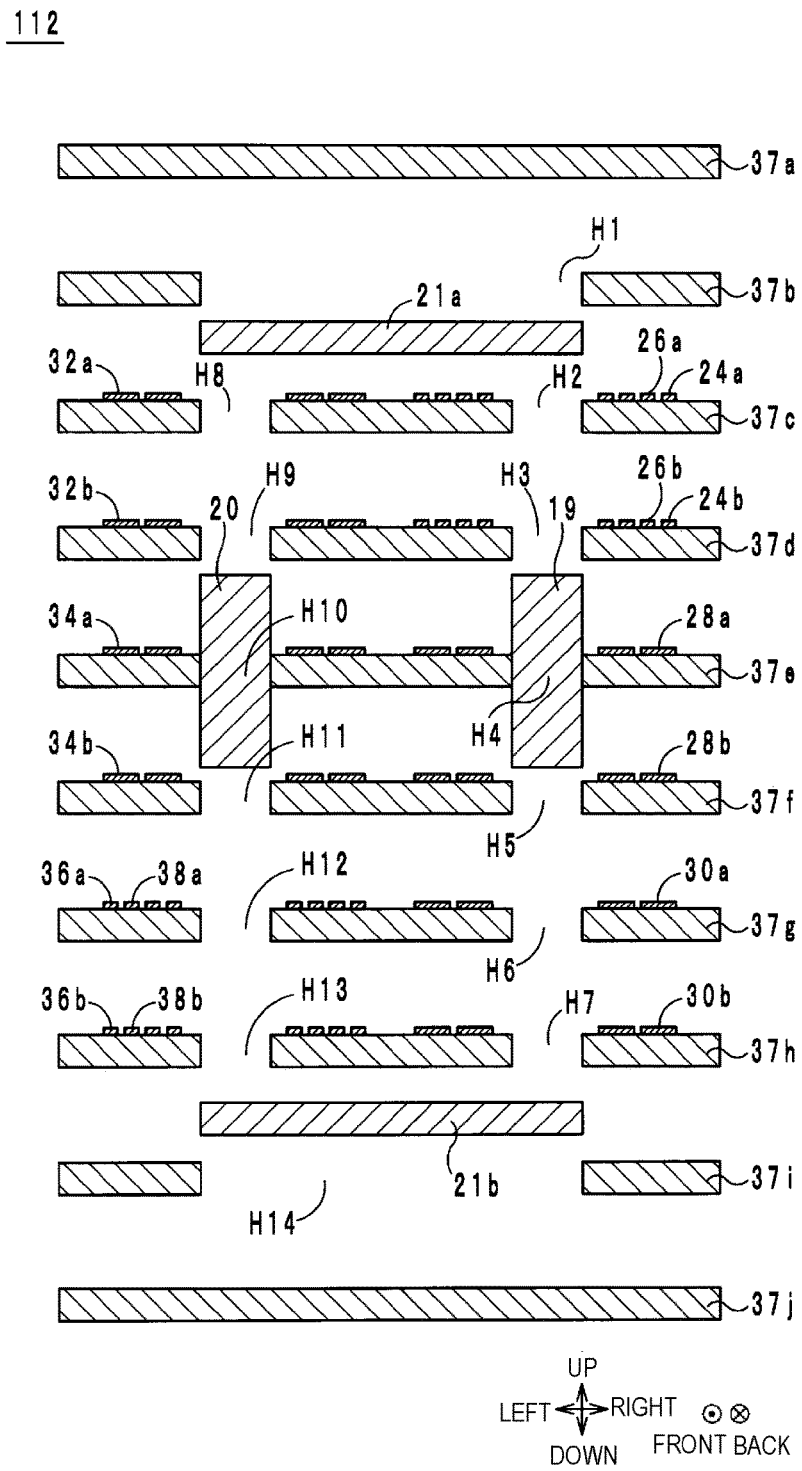
FIG. 10 is a cross-sectional view illustrating a step in the manufacture of the electronic component 10*d*.

Next, a mother multilayer body 112 (not shown) is formed by layering the sheets 137*a* to 137*j* in that order from top to bottom, as illustrated in FIG. 10. At this time, the magnetic body portion 21*a* is inserted into the hole H1, the magnetic body portion 19 is inserted into the holes H2 to H7, the magnetic body portion 20 is inserted into the holes H8 to H13, and the magnetic body portion 21*b* is inserted into the hole H14. The sheets 137*a* to 137*j* are merged by subjecting the mother multilayer body 112 to a heating process as well as a pressurizing process in the up-down direction.

Finally, the mother multilayer body 112 is cut using a dicer or the like to obtain a plurality of the electronic components 10*d*.

(Effects)

The electronic component 10*d* configured as described thus far can provide the same effects as those of the electronic component 10*a*.

In addition, in the electronic component 10*d*, the coil conductors 24*a*, 24*b*, 26*a*, 26*b*, 28*a*, 28*b*, 30*a*, 30*b*, 32*a*, 32*b*, 34*a*, 34*b*, 36*a*, 36*b*, 38*a*, and 38*b* are not drawn out to the longer sides on the front and back of the insulation layers 37*a* to 37*f*. Accordingly, the coil conductors 24*a*, 24*b*, 26*a*, 26*b*, 28*a*, 28*b*, 30*a*, 30*b*, 32*a*, 32*b*, 34*a*, 34*b*, 36*a*, 36*b*, 38*a*, and 38*b* are not exposed on the front-face and rear-face of the multilayer body 12. This suppresses the occurrence of interlayer separation among the insulation layers 37*a* to 37*f*.

In addition, in the electronic component 10*d*, the insulation layers 37*a* to 37*f* are formed from a liquid-crystal polymer. Liquid-crystal polymer is a material that has superior humidity resistance, and thus moisture is suppressed from entering into the multilayer body 12. The coils L1 to L8 within the electronic component 10*d* are therefore suppressed from degrading due to moisture.

Furthermore, liquid-crystal polymer has a comparatively low relative dielectric constant. A capacitance produced between the coil conductors 24*a* and 24*b* of the coil L1 is thus reduced. This reduces the self-resonant frequency of the coil L1. The same applies to the coils L2 to L8.

Note that the magnetic body 22 may be formed from a material obtained by mixing a magnetic material with the same thermoplastic resin as the insulation layers 37*a* to 37*j*. In this case, it is easier to merge the insulation layers 37*a* to 37*j* with the magnetic body 22, and the magnetic body 22 is suppressed from being damaged by the heating process and the pressurizing process.

(Fourth Variation)

Figure 11:
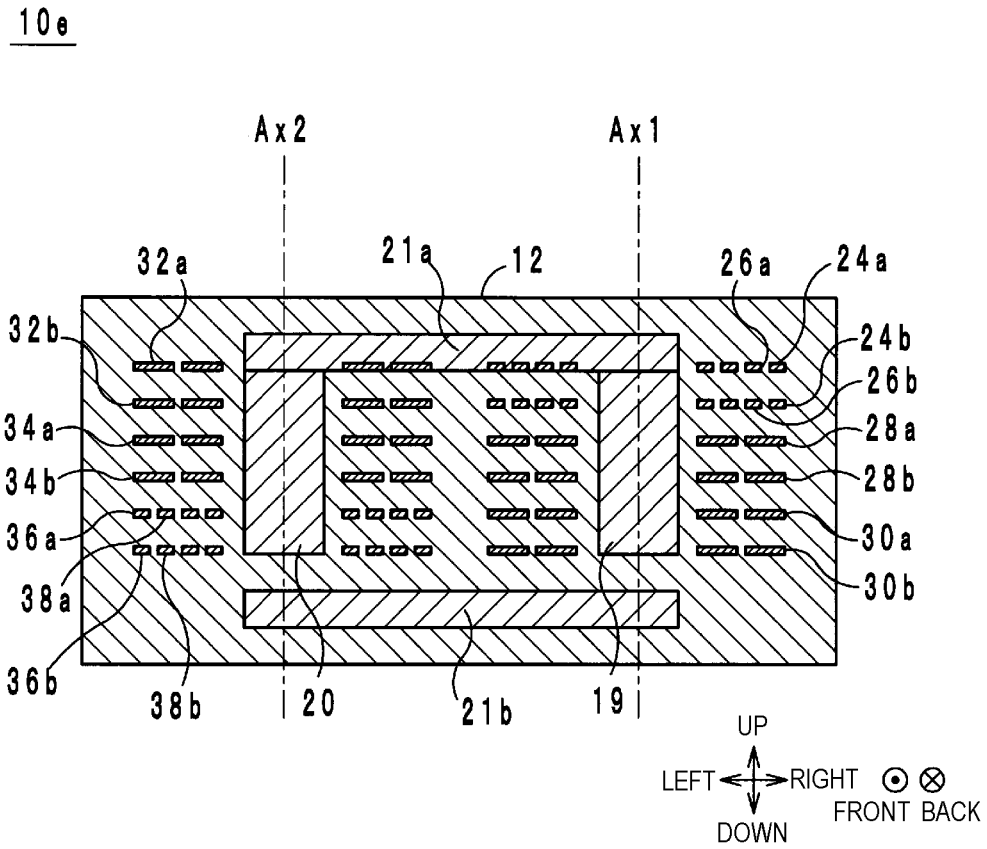
FIG. 11 is a cross-sectional structural diagram illustrating an electronic component 10*e*.

Next, an electronic component 10*e* according to a fourth variation will be described with reference to the drawings. FIG. 11 is a cross-sectional structural diagram illustrating the electronic component 10*e*.

The electronic component 10*e* differs from the electronic component 10*d* in that the lower ends of the magnetic body portions 19 and 20 are not connected to the magnetic body portion 21*b*. In this manner, the magnetic body 22 need not absolutely have a ring shape.

(Fifth Variation)

Figure 12:
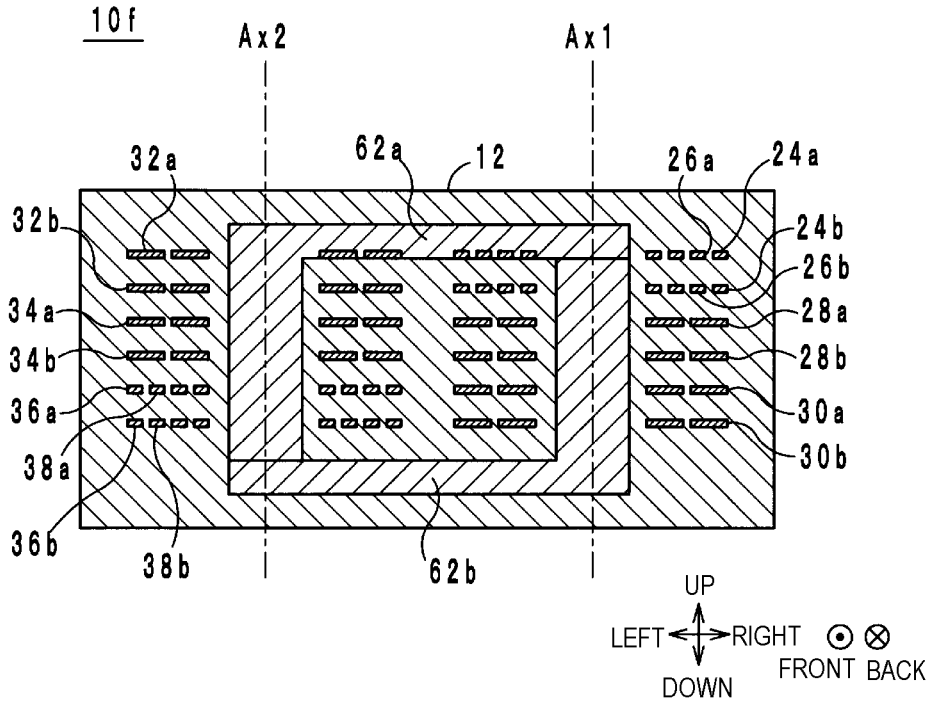
FIG. 12 is a cross-sectional structural diagram illustrating an electronic component 10*f*.

Next, an electronic component 10*f* according to a fifth variation will be described with reference to the drawings. FIG. 12 is a cross-sectional structural diagram illustrating the electronic component 10*f*.

The electronic component 10*f* differs from the electronic component 10*d* in terms of the structure of the magnetic body 22. To be more specific, in the electronic component 10*f*, the magnetic body 22 is constituted of magnetic body portions 62*a* and 62*b*. The magnetic body portion 62*a* has a structure obtained by integrating the magnetic body portion 20 and the magnetic body portion 21*a* of the electronic component 10*d*, and has an L shape when viewed in plan view from the front. The magnetic body portion 62*b* has a structure obtained by integrating the magnetic body portion 19 and the magnetic body portion 21*b* of the electronic component 10*d*, and has an L shape when viewed in plan view from the front.

The magnetic body 22 of the electronic component 10*f* is divided at two locations. On the other hand, the magnetic body 22 of the electronic component 10*d* is divided at four locations. Accordingly, it is easier for a closed magnetic loop to be formed in the magnetic body 22 with the electronic component 10*f* than with the electronic component 10*d*.

(Sixth Variation)

Figure 13:
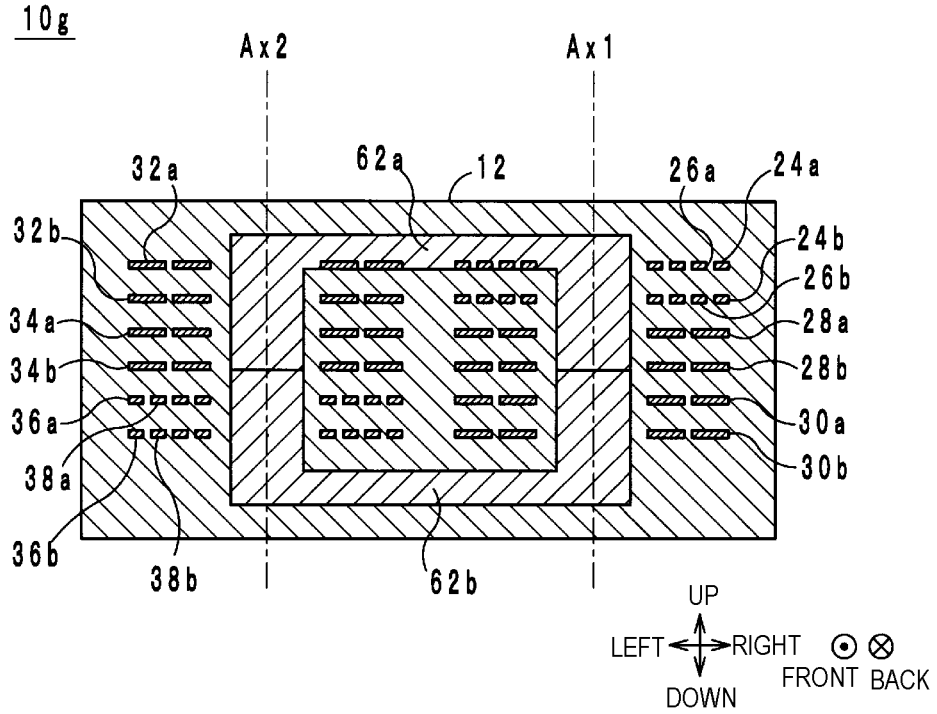
FIG. 13 is a cross-sectional structural diagram illustrating an electronic component 10*g*.

Next, an electronic component 10*g* according to a sixth variation will be described with reference to the drawings. FIG. 13 is a cross-sectional structural diagram illustrating the electronic component 10*g*.

The electronic component 10*g* differs from the electronic component 10*d* in terms of the structure of the magnetic body 22. To be more specific, in the electronic component 10*g*, the magnetic body 22 is constituted of the magnetic body portions 62*a* and 62*b*. The magnetic body portion 62*a* has a structure obtained by integrating the upper halves of the magnetic body portions 19 and 20 and the magnetic body portion 21*a* of the electronic component 10*d*, and has an angular U shape when viewed in plan view from the front. The magnetic body portion 62*b* has a structure obtained by integrating the lower halves of the magnetic body portions 19 and 20 and the magnetic body portion 21*b* of the electronic component 10*d*, and has an angular U shape when viewed in plan view from the front.

The magnetic body 22 of the electronic component 10*g* is divided at two locations. On the other hand, the magnetic body 22 of the electronic component 10*d* is divided at four locations. Accordingly, it is easier for a closed magnetic loop to be formed in the magnetic body 22 with the electronic component 10*g* than with the electronic component 10*d*.

(Seventh Variation)

Figure 14:
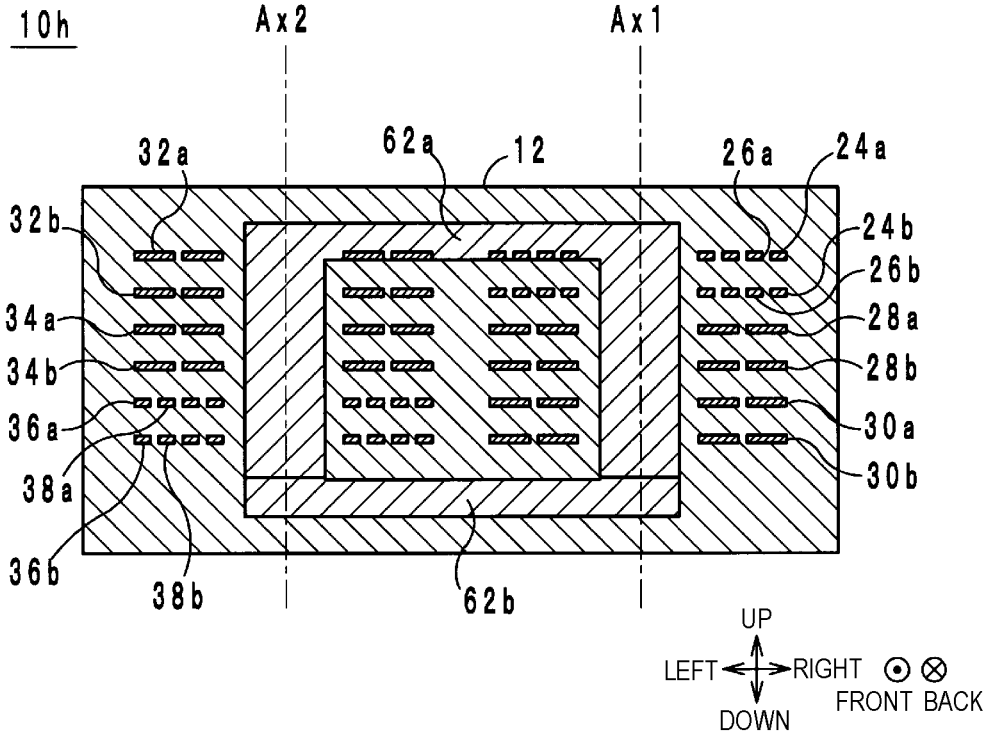
FIG. 14 is a cross-sectional structural diagram illustrating an electronic component 10*h*.

Next, an electronic component 10*h* according to a seventh variation will be described with reference to the drawings. FIG. 14 is a cross-sectional structural diagram illustrating the electronic component 10*h*.

The electronic component 10*h* differs from the electronic component 10*d* in terms of the structure of the magnetic body 22. To be more specific, in the electronic component 10*h*, the magnetic body 22 is constituted of the magnetic body portions 62*a* and 62*b*. The magnetic body portion 62*a* has a structure obtained by integrating the magnetic body portions 19 and 20 and the magnetic body portion 21*a* of the electronic component 10*d*, and has an angular U shape when viewed in plan view from the front. The magnetic body portion 62*b* is the magnetic body portion 21*b* of the electronic component 10*d*.

The magnetic body 22 of the electronic component 10*h* is divided at two locations. On the other hand, the magnetic body 22 of the electronic component 10*d* is divided at four locations. Accordingly, it is easier for a closed magnetic loop to be formed in the magnetic body 22 with the electronic component 10*h* than with the electronic component 10*d*.

Other Embodiments

The electric circuit according to the present disclosure is not limited to the above-described electronic components 10*a* to 10*h*, and can be modified without departing from the essential spirit thereof.

Although the coil conductors 24*a*, 24*b*, 26*a*, 26*b*, 28*a*, 28*b*, 30*a*, 30*b*, 32*a*, 32*b*, 34*a*, 34*b*, 36*a*, 36*b*, 38*a*, and 38*b* are described as having spiral shapes, the stated coil conductors may have helical shapes instead. "Spiral shape" refers to the conductor circling a plurality of times within the same plane, whereas "helical shape" refers to the conductor progressing in a predetermined direction while circling around a center axis extending in the predetermined direction. The number of turns in the coils L1 to L8 may be a single turn or less.

In addition, in the electronic component 10*a*, the region where the coil L1 is provided matches the region where the coil L5 is provided in the up-down direction. However, part of the region where the coil L1 is provided and part of the region where the coil L5 is provided may overlap in the up-down direction. Even in such a case, it is possible to reduce the profile of the electronic component 10*a*. Note that the region where the coil L1 is provided and the region where the coil L6 is provided may overlap in the up-down direction.

Meanwhile, the region where the coil L1 is provided may be located between the region where the coil L5 is provided and the region where the coil L6 is provided in the up-down direction. Even in such a case, the region where the coil L5 is provided and the region where the coil L6 is provided can be brought closer together in the up-down direction, which makes it possible to reduce the profile of the electronic component 10*a*.

In addition, in the electronic components 10*a* to 10*h*, the center axes of the coils L1 to L4 need not match when viewed in plan view from above. The coils L1 to L4 may wind around a single virtual axis extending in the up-down direction when viewed in plan view from above in order to electromagnetically couple with each other. In addition, the center axes of the coils L5 to L8 need not match when viewed in plan view from above. The coils L5 to L8 may wind around a single virtual axis extending in the up-down direction when viewed in plan view from above in order to electromagnetically couple with each other.

In the electronic components 10*a* to 10*h*, it is sufficient for the orientation of a magnetic field produced by the coils L1 to L4 at the axis Ax1 and the orientation of a magnetic field produced by the coils L5 to L8 at the axis Ax2 to be reversed when a common mode signal is inputted to each of the coils L1 to L8. Accordingly, the coils L1 to L4 need not wind in the same direction when viewed in plan view from above, and the coils L5 to L8 need not wind in the same direction when viewed in plan view from above. This will be described using the coils L5 and L6 of the electronic component 10*a* as an example.

The coil conductor 32*b* of the coil L5 has a spiral shape that progresses inward while winding clockwise, and the coil conductor 32*a* of the coil L5 has a spiral shape that progresses outward while winding clockwise. In this case, when a current flows from the outer electrode 14*h* toward the outer electrode 14*p* in the coil conductors 32*a* and 32*b* of the coil L5, the current circles clockwise when viewed in plan view from above. The coil conductor 34*b* of the coil L6 has a spiral shape that progresses inward while winding clockwise, and the coil conductor 34*a* of the coil L6 has a spiral shape that progresses outward while winding clockwise. In this case, when a current flows from the outer electrode 14*e* toward the outer electrode 14*m* in the coil conductors 34*a* and 34*b* of the coil L6, the current circles clockwise when viewed in plan view from above. In other words, in the coils L5 and L6, the currents circle in the same direction, and a magnetic flux oriented downward is produced in the coils L5 and L6.

However, the winding direction of the coil L5 and the winding direction of the coil L6 may be opposite. For example, the coil conductor 32*b* of the coil L5 may have a spiral shape that progresses inward while winding clockwise, the coil conductor 32*a* of the coil L5 may have a spiral shape that progresses outward while winding clockwise, the coil conductor 34*a* of the coil L6 may have a spiral shape that progresses inward while winding counterclockwise, and the coil conductor 34*b* of the coil L6 may have a spiral shape that progresses outward while winding counterclockwise. In this case, when a current flows from the outer electrode 14*m* toward the outer electrode 14*e* in the coil conductors 34*a* and 34*b* of the coil L6, the current circles counterclockwise when viewed in plan view from above. In other words, in the coils L5 and L6, the currents circle in the same direction, and a magnetic flux oriented downward is produced in the coils L5 and L6.

In addition, although the coil conductors 34*a* and 34*b* of the coil L6 are provided below the coil L5 in the electronic component 10*a*, the coil conductor 34*a* may be provided below the coil L5 and the coil conductor 34*b* may be provided below the coil L1.

In addition, a compact formed by curing a resin may be used as the main body of the electronic components 10*a* to 10*h* instead of the multilayer body 12.

The magnetic body 22 is not a required constituent element in the electronic components 10*a* to 10*h*.

The number of coils is not limited to eight.

The electric circuit according to the present disclosure is not limited to the electronic components 10*a* to 10*h*, and can be applied in circuit boards as well.

The configurations of the electronic components 10*a* to 10*d* may be combined as desired.

INDUSTRIAL APPLICABILITY

The present disclosure is useful in electric circuits, and is particularly advantageous in its ability to reduce the size of an electric circuit.

The invention claimed is:

1. An electric circuit comprising:

a main body;

a first inductor, provided in the main body, that winds around a first axis extending along a first direction when viewed in plan view from the first direction;

a second inductor, provided in the main body, that winds around a second axis extending along the first direction when viewed in plan view from the first direction; and a third inductor, provided in the main body, that winds around the first axis when viewed in plan view from the first direction, wherein a position of the first axis and a position of the second axis are different when viewed in plan view from the first direction;

the first inductor, the second inductor and the third inductor form a common mode choke coil;

a second region where the second inductor is provided at least partially overlaps, when viewed in a second direction perpendicular to the first direction, with a first region where the first inductor is provided or a third region where the third inductor is provided, or is positioned between the first region and the third region when viewed in the second direction;

one each of a power source potential, a ground potential, and a first signal is applied to one each of the first inductor, the second inductor, and the third inductor so that the same potential or signal is not applied to more than one of the first inductor, the second inductor and the third inductor; and when a common mode signal is inputted to the first inductor, the second inductor and the third inductor, an orientation of a magnetic field produced in the first axis by the first inductor and the third inductor is the opposite from an orientation of a magnetic field produced in the second axis by the second inductor.

2. The electric circuit according to claim 1, wherein a center axis of the first inductor and the third inductor is the first axis.

3. The electric circuit according to claim 1, further comprising:

a fourth inductor, provided in the main body, that winds around the second axis when viewed in plan view from the first direction, wherein one each of the power source potential, the ground potential, the first signal and a second signal is applied to one each of the first inductor, the second inductor, the third inductor and the fourth inductor so that the same potential or signal is not applied to more than one of the first inductor, second inductor, third inductor and the fourth inductor; and when a common mode signal is inputted to the first inductor, second inductor, third inductor and the fourth inductor, the orientation of a magnetic field produced in the first axis by the first inductor and the third inductor is the opposite from an orientation of a magnetic field produced in the second axis by the second inductor and the fourth inductor.

4. The electric circuit according to claim 3, wherein a region where the second inductor is provided and a region where the fourth inductor is provided match when viewed in the second direction.

5. The electric circuit according to claim 4, wherein the fourth inductor has a shape that conforms to the shape of the second inductor when viewed in plan view from the first direction.

6. The electric circuit according to claim 3, wherein the first signal is applied to the second inductor;

the second signal is applied to the fourth inductor; and the first signal and the second signal are differential transmission signals.

7. The electric circuit according to claim 1, wherein the main body includes a magnetic body for causing the first inductor, the second inductor and the third inductor to magnetically couple with each other.

8. The electric circuit according to claim 7, wherein the magnetic body includes a first magnetic body provided along the first axis and passing through the first inductor and the third inductor and a second magnetic body provided along the second axis and passing through the second inductor.

9. The electric circuit according to claim 8, wherein an area of a cross-section of the first magnetic body orthogonal to the first direction is substantially equal to an area of a cross-section of the second magnetic body orthogonal to the first direction.

10. The electric circuit according to claim 8, wherein the magnetic body further includes a third magnetic body that connects one end of the first magnetic body in the first direction to one end of the second magnetic body in the first direction and a fourth magnetic body that connects another end of the first magnetic body in the first direction to another end of the second magnetic body in the first direction.

11. The electric circuit according to claim 1, wherein the first inductor to the third inductor have a spiral shape or a helical shape.

12. The electric circuit according to claim 11, wherein the first inductor, the second inductor and the third inductor have substantially the same number of turns;

the first inductor, the second inductor and the third inductor have substantially the same inductance value; and each coupling of the first inductor, the second inductor and the third inductor has substantially the same degree of coupling.

13. The electric circuit according to claim 1, wherein the first inductor, the second inductor and the third inductor have substantially the same line width.

14. The electric circuit according to claim 1, wherein the main body is formed by layering a plurality of insulation layers in the first direction;

the first inductor, the second inductor and the third inductor are formed of conductor layers provided on the insulation layers; and the first inductor, the second inductor and the third inductor have substantially the same thickness in the first direction.

15. The electric circuit according to claim 1, wherein of the first inductor, the second inductor and the third inductor, the inductor to which the power source potential is applied and the inductor to which the ground potential is applied have a thicker line width than the inductor, of the first inductor, the second inductor and the third inductor, to which the first signal is applied.

16. The electric circuit according to claim 1, wherein of the first inductor, the second inductor and the third inductor, the inductor to which the power source potential is applied and the inductor to which the ground potential is applied are thicker in the first direction than the inductor, of the first inductor, the second inductor and the third inductor, to which the first signal is applied.

17. The electric circuit according to claim 1, wherein the first region and the second region match when viewed in the second direction.

18. The electric circuit according to claim 3, wherein the main body is formed by layering a plurality of insulation layers in the first direction;

the electric circuit further comprises at least one fifth inductor that forms a common mode choke coil with the first inductor, the second inductor and the third inductor;

wherein the first inductor, the second inductor, the third inductor and the fifth inductor are formed of conductor layers provided on the insulation layers; and the conductor layers that form the first inductor, the second inductor, the third inductor and the fifth inductor have, on the corresponding insulation layers, a substantially linearly symmetrical structure relative to a perpendicular bisector of the first axis and the second axis.

19. The electric circuit according to claim 3, further comprising:

a plurality of fifth inductors that form a common mode choke coil with the first inductor, the second inductor and the third inductor, wherein an order, in the first direction, in which the power source potential, the ground potential, and the signal applied to the first inductor, the third inductor, and the fifth inductors that wind around the first axis are arranged is the opposite from an order, in the first direction, in which the power source potential, the ground potential, and the signal applied to the second inductor and the fifth inductors that wind around the second axis are arranged.

* * * * *